US010009967B2

(12) United States Patent
Lee et al.

(10) Patent No.: US 10,009,967 B2
(45) Date of Patent: Jun. 26, 2018

(54) BACKLIGHT UNIT, METHOD OF DRIVING THE SAME, AND DISPLAY APPARATUS HAVING THE SAME

(71) Applicant: SAMSUNG DISPLAY CO., LTD., Yongin-si, Gyeonggi-do (KR)

(72) Inventors: Dae-sik Lee, Asan-si (KR); Seokhwan Lee, Seoul (KR); Won-hyoung Kang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days. days.

(21) Appl. No.: 15/048,448

(22) Filed: Feb. 19, 2016

(65) Prior Publication Data

US 2016/0323946 A1 Nov. 3, 2016

(30) Foreign Application Priority Data

Apr. 30, 2015 (KR) ..... 10-2015-0062093

(51) Int. Cl.
*H05B 33/08* (2006.01)

(52) U.S. Cl.
CPC ..... *H05B 33/0815* (2013.01); *H05B 33/0827* (2013.01)

(58) Field of Classification Search
CPC ..... G02F 2001/133612; G09G 2310/0237; G09G 2310/08; G09G 2310/0233; G09G 2310/0626; G09G 2310/064; G09G 2330/025; G09G 2330/045; G09G 3/00; G09G 3/3406; G09G 3/342; G09G 5/10; H05B 33/0815; H05B 33/0827; H05B 33/086

See application file for complete search history.

(56) References Cited

U.S. PATENT DOCUMENTS 8,269,425 B2 * 9/2012 Kawata ..... H05B 33/0818 315/291
8,643,587 B2 * 2/2014 Ha ..... G09G 3/3413 345/102
9,232,608 B2 * 1/2016 Fujita ..... G09G 3/3426
2014/0218657 A1 * 8/2014 Haruta ..... G09G 3/342 349/61

(Continued)

FOREIGN PATENT DOCUMENTS

KR 10-2005-0120901 A 12/2005
KR 10-2011-0072692 A 6/2011
KR 10-2012-0010482 A 2/2012

(Continued)

*Primary Examiner* — Alexander H Taningco
*Assistant Examiner* — Seokjin Kim
(74) *Attorney, Agent, or Firm* — Lewis Roca Rothgerber Christie LLP

(57) ABSTRACT

A backlight unit includes a light source part, a DC/DC converter, and a light source driving circuit. The DC/DC converter receives an input voltage and provides a driving voltage to the light source part. The light source driving circuit receives an analog voltage, generates a clamping voltage on the basis of the analog voltage, and generates a main driving signal applied to the DC/DC converter on the basis of the analog voltage and the clamping voltage. The light source driving circuit decreases a duty ratio of the main driving signal when the analog voltage is equal to or lower than a reference voltage.

15 Claims, 12 Drawing Sheets

(56) References Cited

U.S. PATENT DOCUMENTS

2016/0140912 A1* 5/2016 Im ..... G09G 3/003
345/690

FOREIGN PATENT DOCUMENTS

| | | | |
|---|---|---|---|
| KR | 10-2014-0047200 | A | 4/2014 |
| KR | 10-2014-0076098 | A | 6/2014 |
| KR | 10-2016-0032380 | | 3/2016 |

* cited by examiner

BACKLIGHT UNIT, METHOD OF DRIVING THE SAME, AND DISPLAY APPARATUS HAVING THE SAME

CROSS-REFERENCE TO RELATED APPLICATION

This patent application claims priority to and the benefit of Korean Patent Application No. 10-2015-0062093, filed on Apr. 30, 2015, the content of which is hereby incorporated by reference in its entirety.

BACKGROUND

1. Field

Aspects of embodiments of the present invention relate to a backlight unit, a method of driving the same, and a display apparatus having the same.

2. Description of the Related Art

A display apparatus may be classified into a self-emissive display apparatus, such as an organic light emitting diode display (OLED), a field emission display (FED), a vacuum fluorescent display (VFD), a plasma display panel (PDP), etc., and a non-self-emissive display apparatus, such as a liquid crystal display (LCD), an electrophoretic display, etc.

A non-self-emissive display apparatus may include a backlight unit for generating light. For example, the backlight unit may include a light source emitting the light. Various light sources, for example, a cold cathode fluorescent lamp (CCFL), a flat fluorescent lamp (FFL), a light emitting diode (LED), etc., may be utilized as the light source. In recent years, the light emitting diode has become popular, because the light emitting diode has characteristics such as relatively low power consumption and relatively low heat generation.

The backlight unit may control a current flowing through light emitting diode arrays in response to a voltage signal applied thereto, in order to determine a light-emitting brightness of the backlight unit. The backlight unit controls the current flowing through the light emitting diode arrays in a range from a minimum voltage (e.g., a predetermined minimum voltage) to a maximum voltage (e.g., a predetermined maximum voltage).

The above information disclosed in this Background section is only for enhancement of understanding of the background of the invention and therefore it may contain information that does not constitute prior art.

SUMMARY

Aspects of embodiments of the present invention relate to a backlight unit, a method of driving the same, and a display apparatus having the same. Additionally, aspects of some embodiments of the present invention relate to a backlight unit operated at a low voltage, a method of driving the backlight unit, and a display apparatus having the backlight unit.

Aspects of some embodiments of the present invention include a backlight unit capable of lowering a driving current flowing through light emitting diode arrays.

Aspects of some embodiments of the present invention include a method of driving the backlight unit.

Aspects of some embodiments of the present invention include a display apparatus having the backlight unit.

Some embodiments of the present invention include a backlight unit including a light source comprising a light emitting diode array; a DC/DC converter configured to receive an input voltage and to apply a driving voltage to the light emitting diode array; and a light source driving circuit configured to: receive an analog voltage; generate a clamping voltage according to the analog voltage; and generate a main driving signal to be applied to the DC/DC converter according to the analog voltage and the clamping voltage, wherein the analog voltage has a voltage range between a first lower limit and a first upper limit, the clamping voltage has a voltage range between a second lower limit higher than the first lower limit and a second upper limit lower than the first upper limit, the backlight unit is configured to operate in a first mode when the analog voltage has a first level between the second lower limit and the first upper limit, the backlight unit is configured to operate in a second mode when the analog voltage has a second level between the first lower limit and the second lower limit, and the driving voltage during the first mode is different from the driving voltage during the second mode.

According to some embodiments, the light source driving circuit is configured to control the main driving signal to allow the main driving signal in the second mode to have a duty ratio smaller than a duty ratio of the main driving signal in the first mode.

According to some embodiments, the driving voltage decreases as a level of the analog voltage decreases during the second mode.

According to some embodiments, the DC/DC converter comprises: an inductor configured to receive the input voltage at a first terminal; a main diode between a second terminal of the inductor and a first end of the light emitting diode array to apply the driving voltage to the first end of the light emitting diode array; a main transistor comprising a first terminal connected to a node between the inductor and the main diode and a control terminal configured to receive the main driving signal; and a main resistor between a second terminal of the main transistor and a ground.

According to some embodiments, the light source further comprises: a current control transistor comprising a first terminal connected to a second end of the light emitting diode array and a control terminal configured to receive a control signal from the light source driving circuit; and a main resistor connected to a second terminal of the current control transistor and the ground.

According to some embodiments, the light source driving circuit comprises: a voltage range changer configured to generate the clamping voltage; a duty controller configured to generate the main driving signal according to a main node voltage from the second terminal of the main transistor, a light source resistor voltage from the second terminal of the current control transistor, the clamping voltage, a clock signal, and the analog voltage; and a control signal generator configured to generate the control signal according to the clamping voltage and the light source resistor voltage.

According to some embodiments, the duty controller comprises: an error amplifier comprising a first terminal configured to receive the clamping voltage, a second terminal configured to receive the light source resistor voltage, and an output terminal configured to output an amp output signal; an offset compensator configured to receive an amplified main node voltage by amplifying the main node voltage and the analog voltage and compensating for a level of the amplified main node voltage during the second mode to generate a main voltage signal; a main comparator comprising a non-inverting input terminal configured to receive the main voltage signal and an inverting input terminal configured to receive the amp output signal and to compare the main voltage signal and the amp output signal to output a high signal or a low signal; and a latch comprising a set terminal configured to receive the clock signal, a rest terminal configured to receive an output signal from the main comparator, and an output terminal configured to output the main driving signal having a pulse-on period during a period from a rising edge of the clock signal to a rising edge of the output signal of the main comparator.

According to some embodiments, the offset compensator comprises: a comparator comprising a non-inverting input terminal configured to receive the analog voltage and an inverting input terminal configured to receive the second lower limit of the clamping voltage, the comparator being configured to compare the analog voltage and the second lower limit of the clamping voltage to output a high signal or a low signal; a voltage inverter configured to generate an inverted analog voltage by subtracting the analog voltage from the second lower limit of the clamping voltage; an offset transistor comprising a first terminal configured to receive the inverted analog voltage and a control terminal configured to receive an output signal from the comparator; and an adder configured to output a signal obtained by adding the amplified main node voltage and the inverted analog voltage as the main voltage signal when the offset transistor is turned on and to output the amplified main node voltage as the main voltage signal when the offset transistor is turned off.

According to some embodiments, the offset transistor is a field effect transistor with a p-channel.

According to some embodiments, the duty controller comprises: an error amplifier comprising a first terminal configured to receive the clamping voltage, a second terminal configured to receive the light source resistor voltage, and an output terminal configured to output an amp output signal; an offset compensator configured to receive the amp output signal and the analog voltage and to compensate for a level of the amp output signal during the second mode to generate an amp compensation signal; a main comparator comprising a non-inverting input terminal configured to receive an amplified main node voltage obtained by amplifying the main node voltage, the main comparator further comprising an inverting input terminal configured to receive the amp compensation signal, the main comparator being configured to compare the amplified main node voltage and the amp compensation signal to output a high signal or a low signal; and a latch comprising a set terminal configured to receive the clock signal, a rest terminal configured to receive an output signal from the main comparator, and an output terminal configured to output the main driving signal having a pulse-on period during a period from a rising edge of the clock signal to a rising edge of the output signal of the main comparator.

According to some embodiments, the offset compensator comprises: a comparator comprising a non-inverting input terminal configured to receive the analog voltage and an inverting input terminal configured to receive the second lower limit of the clamping voltage, the comparator being configured to compare the analog voltage and the second lower limit of the clamping voltage to output a high signal or a low signal; a voltage inverter configured to generate an inverted analog voltage by subtracting the analog voltage from the second lower limit of the clamping voltage; an offset transistor comprising a first terminal configured to receive the inverted analog voltage and a control terminal configured to receive an output signal from the comparator; and an adder configured to output a signal obtained by adding the amplified main node voltage and the inverted analog voltage as the main voltage signal when the offset transistor is turned on and to output the amplified main node voltage as the main voltage signal when the offset transistor is turned off.

According to some embodiments, the offset transistor is a field effect transistor with a p-channel.

According to some embodiments, the duty controller comprises: an error amplifier comprising a first terminal configured to receive the clamping voltage, a second terminal configured to receive the light source resistor voltage, and an output terminal configured to output an amp output signal; a main comparator comprising a non-inverting input terminal configured to receive an amplified main node voltage by amplifying the main node voltage and an inverting input terminal configured to receive the amp output signal, the main comparator being configured to compare the amplified main node voltage and the amp output signal to output a high signal or a low signal; a latch comprising a set terminal configured to receive the clock signal, a rest terminal configured to receive an output signal output from the main comparator, and an output terminal configured to output an initial main driving signal having a pulse-on period during a period from a rising edge of the clock signal to a rising edge of the output signal of the main comparator; and an offset compensator configured to control a duty ratio of the initial main driving signal during the second mode to generate the main driving signal.

According to some embodiments, the offset compensator comprises: a first comparator comprising a non-inverting input terminal configured to receive the analog voltage and an inverting input terminal configured to receive the second lower limit of the clamping voltage, the first comparator being configured to compare the analog voltage and the second lower limit of the clamping voltage to output a high signal or a low signal; a first offset transistor comprising a first terminal configured to receive the initial main driving signal, a second terminal configured to receive a ground voltage, and a control terminal configured to receive an output signal from the first comparator; a voltage pulse generator configured to receive the analog voltage and the clock signal to generate a voltage pulse signal; a second offset transistor comprising a first terminal configured to receive the second lower limit of the clamping voltage and a control terminal configured to receive the ground voltage when the first offset transistor is turned on; a second comparator comprising a non-inverting input terminal configured to receive the second lower limit of the clamping voltage through a second terminal of the second offset transistor when the second offset transistor is turned on and an inverting input terminal configured to receive the voltage pulse signal and to compare the second lower limit of the clamping voltage and the voltage pulse signal when the second offset transistor is turned on to output a high signal or a low signal; and a third offset transistor comprising a first terminal configured to receive an output signal from the second comparator, a second terminal configured to output the main driving signal, and a control terminal configured to receive the ground voltage when the first offset transistor is turned on.

According to some embodiments, the first offset transistor is a field effect transistor having an n-channel and each of the second and third offset transistors is a field effect transistor having a p-channel.

According to some embodiments, the voltage pulse generator comprises: an integrator configured to receive the clock signal and to integrate the clock signal in a unit of one period to generate a triangular pulse signal; a voltage inverter configured to generate an inverted analog voltage by subtracting the analog voltage from the second lower limit of the clamping voltage; and an adder configured to add the triangular pulse signal and the inverted analog voltage to generate the voltage pulse signal.

According to some example embodiments of the present invention, a display apparatus includes: a display panel configured to display an image; and a backlight configured to provide a light to the display panel, the backlight comprising: a light source comprising a light emitting diode array; a DC/DC converter configured to receive an input voltage and to apply a driving voltage to the light emitting diode array; and a light source driving circuit configured to receive an analog voltage, to generate a clamping voltage according to the analog voltage, and to generate a main driving signal to be applied to the DC/DC converter according to the analog voltage and the clamping voltage, wherein the analog voltage has a voltage range between a first lower limit and a first upper limit, the clamping voltage has a voltage range between a second lower limit higher than the first lower limit and a second upper limit lower than the first upper limit, the backlight is configured to operate in a first mode when the analog voltage has a first level between the second lower limit and the first upper limit, the backlight is configured to operate in a second mode when the analog voltage has a second level between the first lower limit and the second lower limit, and the light source driving circuit is configured to control the main driving signal to allow a duty ratio of the main driving signal during the first mode to be different from a duty ratio of the main driving signal during the second mode.

According to some embodiments, the duty ratio of the main driving signal decreases as a level of the analog voltage decreases during the second mode.

According to some example embodiments of the present invention, in a method of driving a backlight unit, the method includes: generating a clamping voltage having a voltage range between a second lower limit and a second upper limit according to an analog voltage having a voltage range between a first lower limit lower than the second lower limit and a first upper limit higher than the second upper limit; generating a main driving signal applied to a control terminal of a main transistor of a DC/DC converter according to the analog voltage and the clamping voltage; and determining whether or not the analog voltage is equal to or lower than a set reference voltage, wherein a duty ration of the main driving signal decreases as a level of the analog voltage decreases when the analog voltage is equal to or lower than the set reference voltage.

According to some embodiments, the set reference voltage corresponds to the second lower limit.

According to some embodiments of the present invention, the driving current flowing through the light emitting diode arrays may be lowered.

BRIEF DESCRIPTION OF THE DRAWINGS

The above and other aspects of the present invention will become more readily apparent by reference to the following detailed description when considered in conjunction with the accompanying drawings wherein.

DETAILED DESCRIPTION

Figure 1:
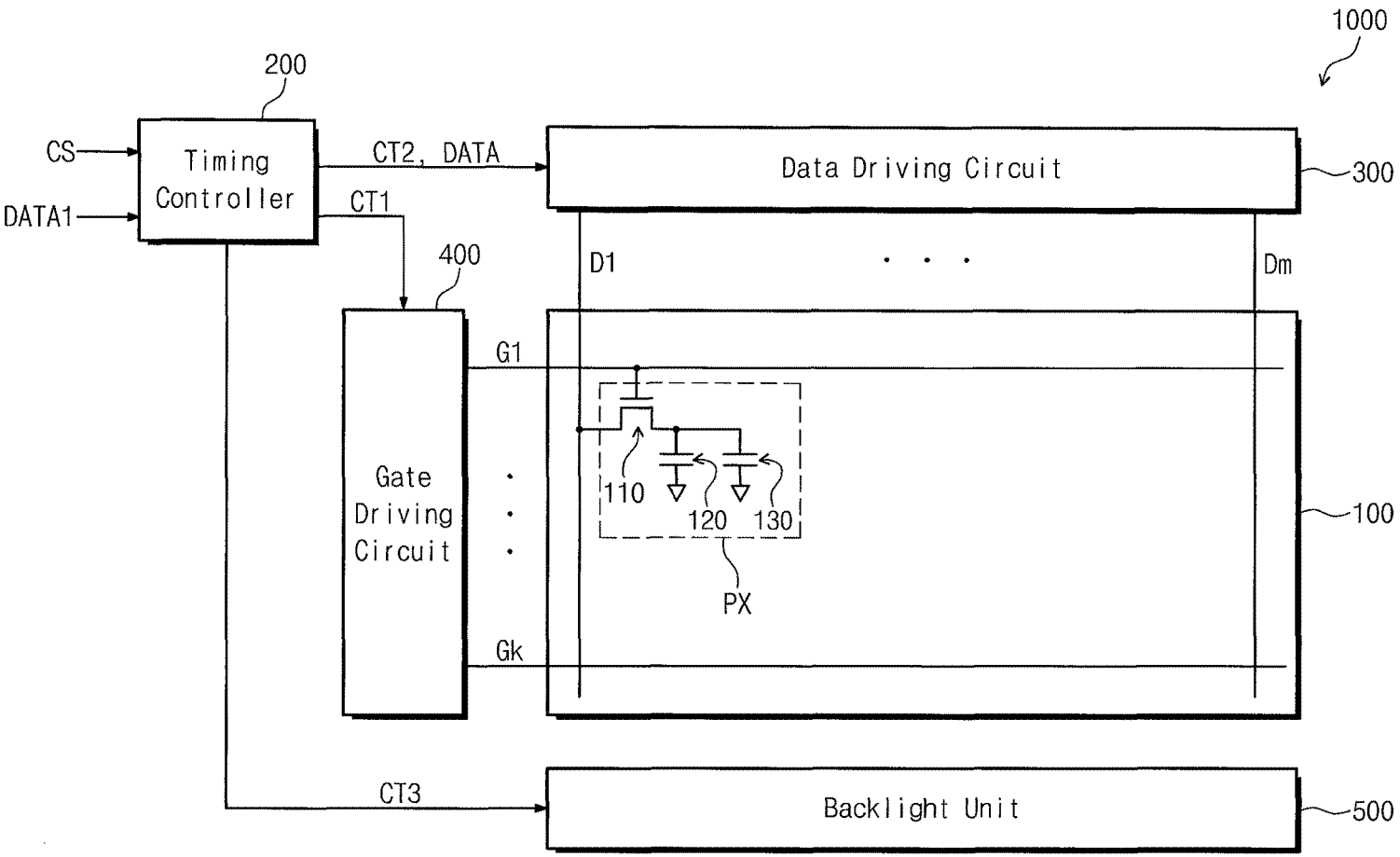
FIG. 1 is a block diagram showing a display apparatus, according to an example embodiment of the present invention.

The following description with reference to the accompanying drawings is provided to assist in a more comprehensive understanding of various embodiments of the present disclosure as defined by the claims and their equivalents. It includes various specific details to assist in that understanding but these are to be regarded as merely examples. Accordingly, those of ordinary skill in the art will recognize that various changes and modifications of the various embodiments described herein can be made without departing from the scope and spirit of the present invention. In addition, descriptions of well-known functions and constructions may be omitted for clarity and conciseness. Unless otherwise noted, like reference numerals denote like elements throughout the attached drawings and the written description, and thus, descriptions thereof will not be repeated. In the drawings, the relative sizes of elements, layers, and regions may be exaggerated for clarity.

The terms and words used in the following description and claims are not limited to the bibliographical meanings, but, are merely used by the inventor to enable a clear and consistent understanding of the present invention. Accordingly, it should be apparent to those skilled in the art that the following description of various embodiments of the present disclosure is provided for illustration purpose only and not for the purpose of limiting the present invention as defined by the appended claims and their equivalents.

Hereinafter, the present invention will be explained in more detail with reference to the accompanying drawings.

FIG. 1 is a block diagram showing a display apparatus 1000 according to an example embodiment of the present invention.

Referring to FIG. 1, the display apparatus 1000 includes a display panel 100, a timing controller 200, a data driving circuit 300, a gate driving circuit 400, and a backlight unit 500.

The display panel 100 displays an image. The display panel 100 may be, but is not limited to, a display panel that displays the image using ambient light rather than a self-emissive display panel, for example, an organic light emitting display panel. For instance, the display panel 100 may be one of a liquid crystal display panel, an electrophoretic display panel, or an electrowetting display panel. Hereinafter, the liquid crystal display panel will be described as the display panel 100, but embodiments of the present invention are not limited thereto.

The display panel 100 includes a plurality of gate lines G1 to Gk receiving gate signals and a plurality of data lines D1 to Dm receiving data voltages. The gate lines G1 to Gk are insulated from the data lines D1 to Dm while crossing the data lines D1 to Dm. The display panel 100 includes a plurality of pixel areas defined therein and arranged in a matrix configuration, and a plurality of pixels is arranged in the pixel areas, respectively. FIG. 1 shows an equivalent circuit diagram of one pixel PX among the pixels as a representative example. The pixel PX includes a thin film transistor 110, a liquid crystal capacitor 120, and a storage capacitor 130.

The thin film transistor 110 includes a control terminal, a first terminal, and a second terminal. The control terminal of the thin film transistor 110 is connected to a first gate line G1 of the gate lines G1 to Gk. The first terminal of the thin film transistor 110 is connected to a first data line D1 of the data lines D1 to Dm. The second terminal of the thin film transistor 110 is connected to the liquid crystal capacitor 120 and the storage capacitor 130. The liquid crystal capacitor 120 and the storage capacitor 130 are connected to the second terminal of the thin film transistor 110 in parallel.

The display panel 100 includes a first display substrate, a second display substrate facing the first display substrate, and a liquid crystal layer arranged between the first and second display substrates.

The gate lines G1 to Gk, the data lines D1 to Dm, the thin film transistor 110, and a pixel electrode that operates as a first electrode of the liquid crystal capacitor 120 are arranged on the first display substrate. The thin film transistor 110 applies the data voltage to the pixel electrode in response to the gate signal.

The second display substrate includes a common electrode that operates as a second electrode of the liquid crystal capacitor 120, and the common electrode is applied with a reference voltage. However, the position of the common electrode should not be limited thereto or thereby. That is, the common electrode may be arranged on the first display substrate according to embodiments.

The liquid crystal layer serves as a dielectric substance between the pixel electrode and the common electrode. The liquid crystal capacitor 120 is charged with a voltage corresponding to a difference in electric potential between the data voltage and the reference voltage.

The timing controller 200 receives image data DATA1 and control signals CS from an external source. The control signals CS include a vertical synchronization signal as a frame distinction signal, a horizontal synchronization signal as a row distinction signal, a data enable signal maintained at a high level during a period, in which data are output, to indicate a data input period.

The timing controller 200 converts the image data DATA1 to image data DATA appropriate to specifications of the data driving circuit 300 and applies the converted image data DATA to the data driving circuit 300.

The timing controller 200 generates a gate control signal CT1, a data control signal CT2, and a backlight control signal CT3 on the basis of the control signals CS. The timing controller 200 applies the gate control signal CT1 to the gate driving circuit 400, applies the data control signal CT2 to the data driving circuit 300, and applies the backlight control signal CT3 to the backlight unit 500.

The gate control signal CT1 is used to control an operation of the gate driving circuit 400. The gate control signal CT1 includes a scan start signal to indicate a scan, at least one clock signal to control an output period of a gate-on voltage, and an output enable signal to determine a maintaining time of the gate-on voltage.

The data control signal CT2 is used to control an operation of the data driving circuit 300. The data control signal CT2 includes a horizontal start signal STH to indicate a transfer of the converted image data DATA to the data driving circuit 300, a load signal to indicate application of the data voltages to the data lines D1 to Dm, and an inversion signal to invert a polarity of the data voltages with respect to the reference voltage.

The backlight control signal CT3 is used to control an operation of the backlight unit 500. The backlight control signal CT3 includes an input voltage Vin, an analog voltage Vg, a clock signal CLK, and a duty control signal for determining a duty ratio of the backlight unit 500.

The data driving circuit 300 generates grayscale voltages in accordance with the image data DATA converted on the basis of the data control signal CT2 and applies the grayscale voltages to the data lines D1 to Dm as the data voltages.

The gate driving circuit 400 generates the gate signals on the basis of the gate control signal CT1 and applies the gate signals to the gate lines G1 to Gk.

The backlight unit 500 is arranged under the display panel 100. The backlight unit 500 provides the light to the display panel in response to the backlight control signal CT3.

Figure 2:
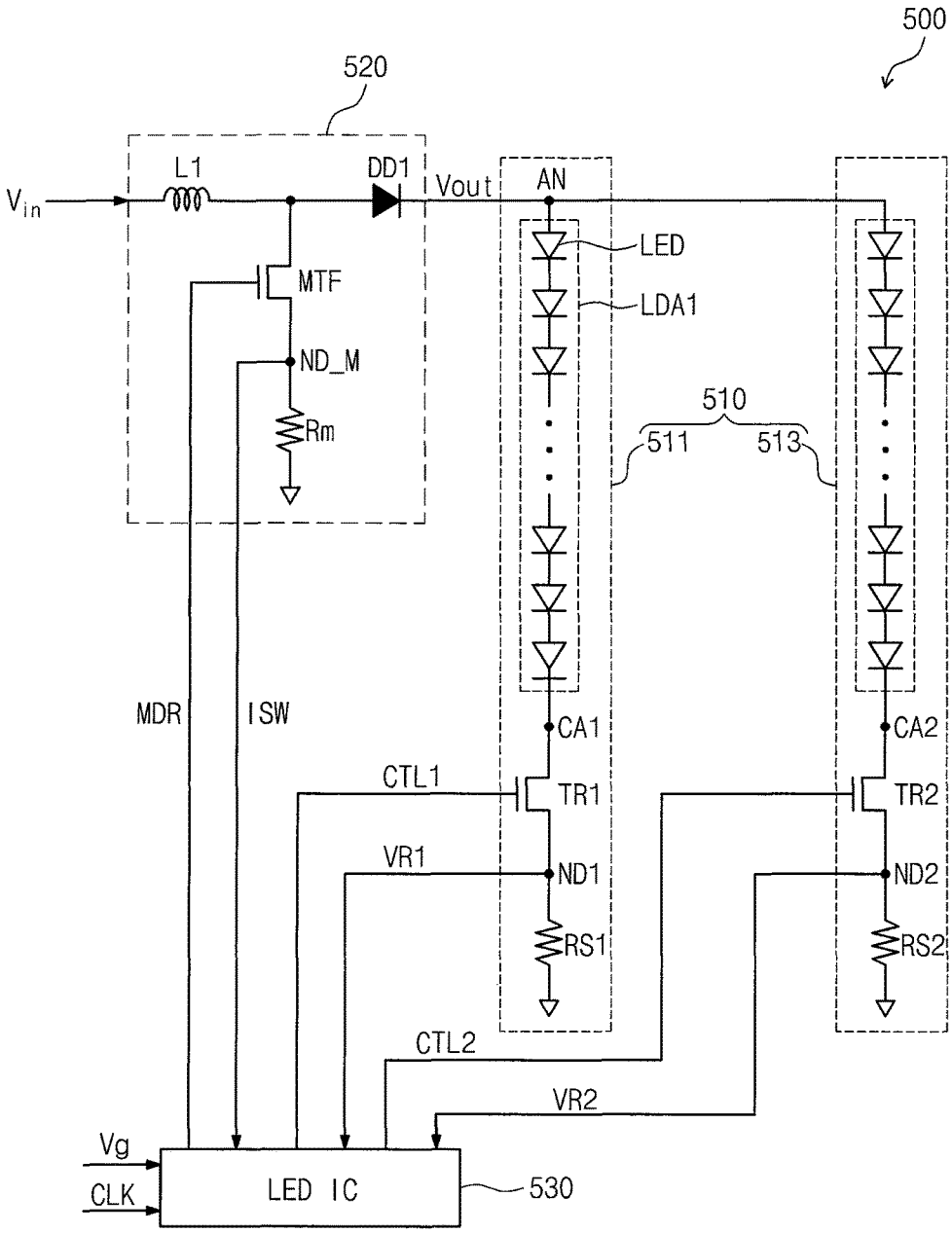
FIG. 2 is a circuit diagram showing further detail of a backlight unit shown in FIG. 1.

FIG. 2 is a circuit diagram showing the backlight unit 500 shown in FIG. 1.

Referring to FIG. 2, the backlight unit 500 includes a light source part (or light source) 510, a DC/DC converter 520, and a light source driving circuit 530.

The light source part 510 includes a first light source part (or first light source) 511 and a second light source part (or second light source) 513. The first and second light source parts 511 and 513 are connected to each other in parallel. One end of the first light source part 511 and one end of the second light source part 513 are connected to each other to receive a driving voltage Vout. The other end of the first light source part 511 and the other end of the second light source part 513 are grounded. The number of the light source parts 510 should not be limited to two. That is, the light source part 510 may be provided as three or more in number.

The first light source part 511 includes a first light emitting diode array LDA1, a first current control transistor TR1, and a first resistor RS1.

The first light emitting diode array LDA1 includes a plurality of light emitting diodes LED connected to each other in series. The first light emitting diode array LDA1 has a light-emitting brightness determined by a current corresponding to a voltage difference between an anode AN and a cathode CA1.

The first current control transistor TR1 is a three-terminal transistor including a first terminal, a second terminal, and a control terminal. The first current control transistor TR1 may be, but is not limited to, a field effect transistor (FET) or a bipolar junction transistor (BJT).

In the present example embodiment, the first current control transistor TR1 may be a metal-oxide-semiconductor field-effect transistor (MOSFET) with an n-channel. The first current control transistor TR1 is operated in a region in which a current flowing through the first terminal increases when the voltage between the first and second terminals increases.

The first terminal of the first current control transistor TR1 is connected to the cathode CA1 of the first light emitting diode array LDA1. The control terminal of the first current control transistor TR1 receives a first control signal CTL1 from the light source driving circuit 530. A current flowing through the first light emitting diode array LDA1 is changed depending on a level of the first control signal CTL1.

The first resistor RS1 is connected to the second terminal of the first current control transistor TR1. The first resistor RS1 has a constant resistance. A first node between the first resistor RS1 and the first current control transistor TR1 is connected to the light source driving circuit 530. The light source driving circuit 530 receives a voltage of the first node ND1 as a first node voltage VR1.

The second light source 513 includes a second light emitting diode array LDA2, a second current control transistor TR2, and a second resistor RS2. The first and second light emitting diode arrays LDA1 and LDA2 are controlled to have different brightnesses. In the present example embodiment, because the first and second light source parts 511 and 513 have the same or similar structure and function, some details of the second light source part 513 will be omitted.

The DC/DC converter 520 receives the input voltage Vin, generates the driving voltage Vout, and applies the driving voltage Vout to the anode AN of the first and second light emitting diode arrays LDA1 and LDA2. The driving voltage Vout and the input voltage Vin are a direct-current voltage and have different voltage levels. For instance, the driving voltage Vout has a voltage level obtained by boosting the input voltage Vin.

The DC/DC converter 520 includes an inductor L1, a main transistor MTF, a main resistor Rm, and a main diode DD1.

One end of the inductor L1 receives the input voltage Vin and the other end of the inductor L1 is connected to the main diode DD1. The main diode DD1 is connected between the inductor L1 and the anode AN of the first and second light emitting diode arrays LDA1 and LDA2. The main diode DD1 transmits a current flowing from the inductor L1 to the anode AN and blocks a current flowing from the anode AN to the inductor L1.

The main transistor MTF is a three-terminal transistor including a first terminal, a second terminal, and a control terminal. The main transistor MTF may be, but is not limited to, a field effect transistor (FET) or a bipolar junction transistor (BJT).

In the present example embodiment, the main transistor MTF is a metal-oxide-semiconductor field effect transistor (MOSFET) with an n-channel.

The first terminal of the main transistor MTF is connected to a node between the inductor L1 and a main diode DD1. The second terminal of the main transistor MTF is connected to the main resistor Rm. The control terminal of the main transistor MTF receives a main driving signal MDR from the light source driving circuit 530. The main transistor MTF is turned on during a high period of the main driving signal MDR and turned off during a low period of the main driving signal MDR.

The main resistor Rm is connected to a node between the second transistor of the main transistor MTF and a ground. The main resistor Rm has a constant resistor. A node between the main transistor MTF and the main resistor Rm is referred to as a main node ND_M.

The main diode DD1 is connected between the other end of the inductor L1 and the anode AN of the first light emitting diode array LDA1. The main diode DD1 transmits a current flowing from the inductor L1 or the main transistor MTF to the anode AN of the first light emitting diode array LDA1 and blocks a current flowing from the anode AN of the first light emitting diode array LDA1 to the inductor L1 or the main transistor MTF.

The light source driving circuit 530 controls the light emitting brightness of the first and second light emitting diode arrays LDA1 and LDA2. The light source driving circuit 530 receives the analog voltage Vg and the clock signal CLK, receives a voltage of the main node ND_M as a main node voltage ISW, and receives the first node voltage VR1 and the second node voltage VR2. The light source driving circuit 530 generates a first control signal CTL1, a second control signal CTL2, and a main driving signal MDR on the basis of the analog voltage Vg, the main node voltage ISW, the first node voltage VR1, and the second node voltage VR2.

The backlight unit 500 is operated in a first mode or a second mode. The first mode is a normal mode, and the backlight unit 500 is operated in the first mode when the voltage level of the analog voltage Vg exceeds a reference voltage (e.g., a predetermined or set reference voltage). When the backlight unit 530 is operated in the first mode, a voltage level of the cathode CA1 of the first light emitting diode array LDA1 is controlled to control the current flowing through the first light emitting diode array LDA1. In the first mode, the voltage level of the first control signal CTL1 is controlled to control the voltage level of the cathode CA1 of the first light emitting diode array LDA1.

When the voltage level of the analog voltage Vg exceeds the reference voltage (e.g., the predetermined or set reference voltage), the driving current flowing through the first and second light emitting diode arrays LDA1 and LDA2 exceeds a reference current (e.g., a predetermined or set reference current). When the voltage level of the driving voltage Vout is changed in the first mode, a difference between the driving current flowing through the first light emitting diode array LDA1 and the driving current flowing through the second light emitting diode array LDA2 increases and a difference in light emitting brightness between the first and second light emitting diode arrays LDA1 and LDA2 increases.

The second mode is a low voltage mode. The backlight unit 500 is operated in the second mode when the voltage level of the analog voltage Vg is equal to or lower than the reference voltage (e.g., the predetermined reference voltage). When the backlight unit 500 is operated in the second mode, the voltage of the anode AN of the first light emitting diode array LDA1 is different from that of the anode AN in the first mode. Because the voltage of the anode AN of the first light emitting diode arrays LDA1 is controlled, the driving current flowing through the first light emitting diode array LDA1 may be controlled. The duty ratio of the main driving signal MDR is controlled in the second mode.

When the voltage level of the analog voltage Vg is equal to or lower than the reference voltage (e.g., the predetermined reference voltage), the driving current flowing through the first and second light emitting diode arrays LDA1 and LDA2 is equal to or lower than the reference current (e.g., the predetermined reference current). Because the driving current flowing through the first and second light emitting diode arrays LDA1 and LDA2 is very low, the voltage level of the driving voltage Vout is changed, and thus the difference between the driving current flowing through the first light emitting diode array LDA1 and the driving current flowing through the second light emitting diode array LDA2 is substantially reduced. Accordingly, when the voltage level of the analog voltage Vg is equal to or lower than the reference voltage (e.g., the predetermined reference voltage), the driving voltage Vout becomes lower compared to that in the first mode, and thus the driving current flowing through the first and second light emitting diode arrays LDA1 and LDA2 is decreased.

Figure 3:
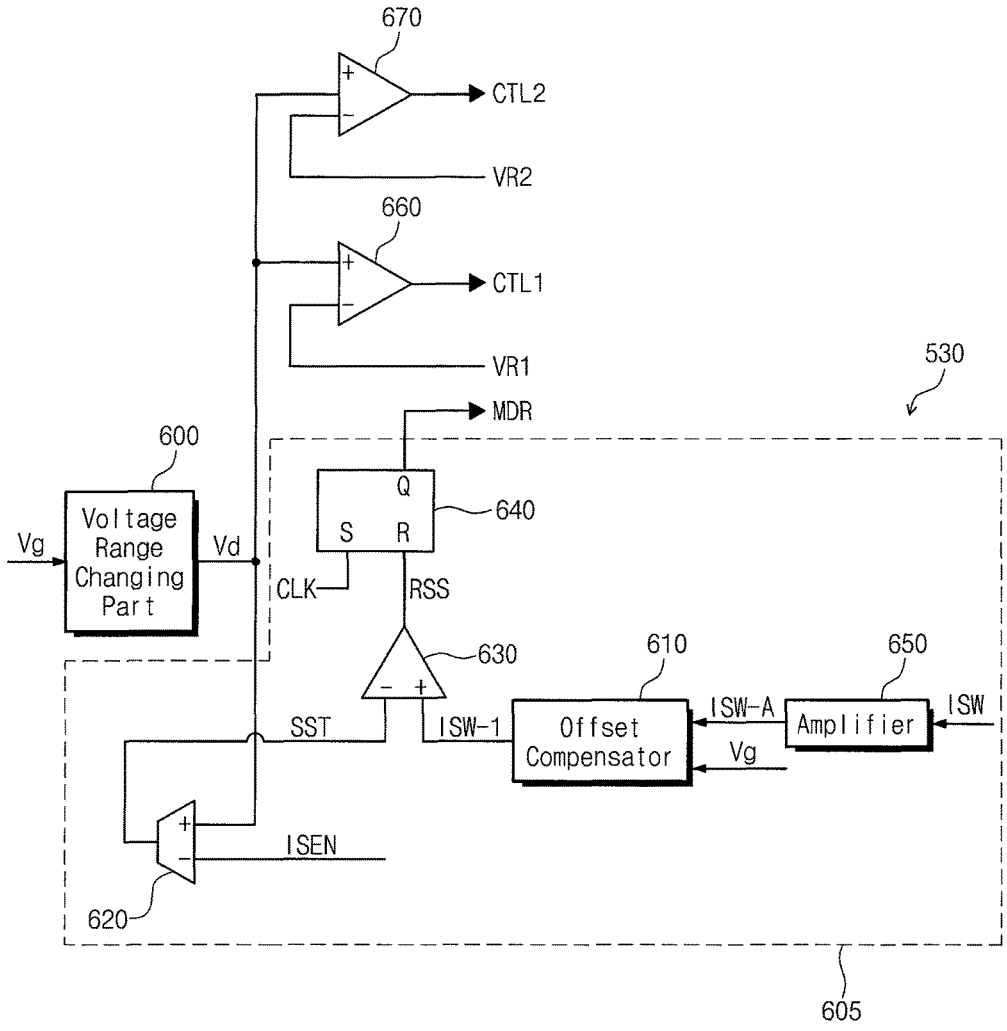
FIG. 3 is a circuit diagram showing further detail of a light source driving circuit shown in FIG. 2.
Figure 4:
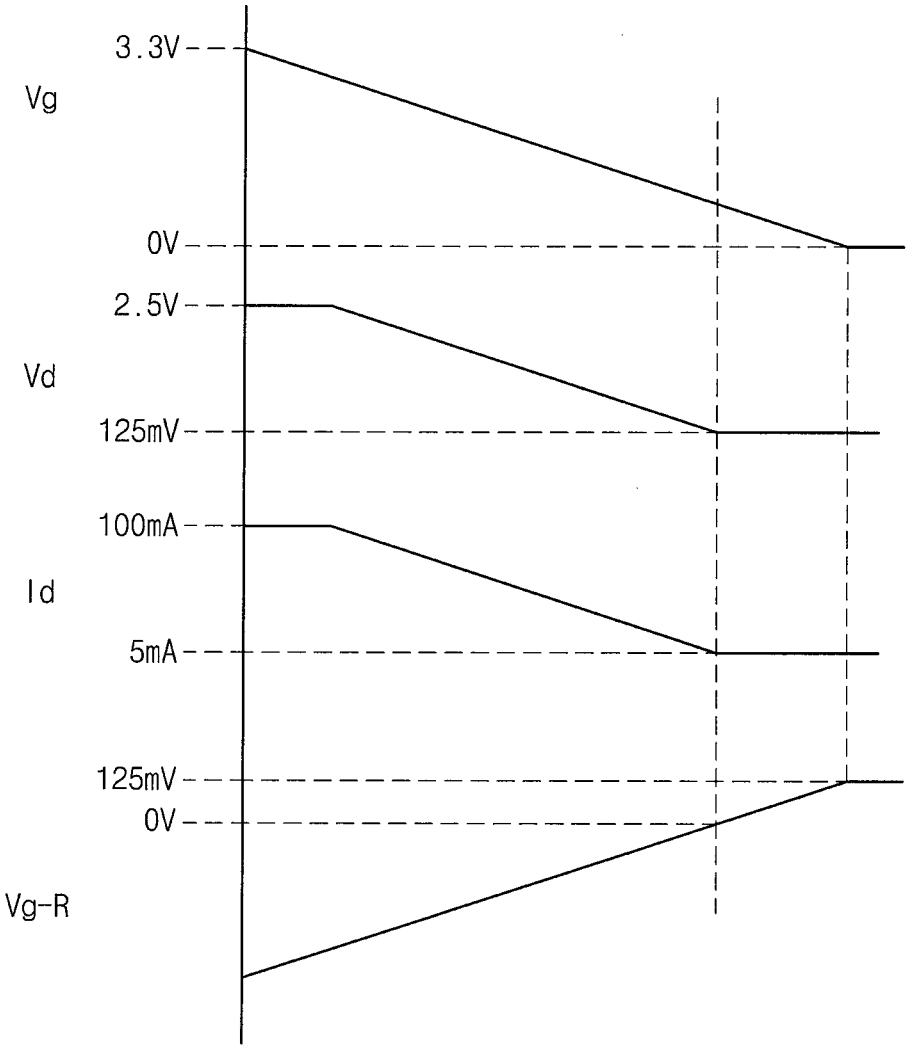
FIG. 4 is a waveform diagram showing an analog voltage, a clamping voltage, and a current flowing through a first light emitting diode array, according to an example embodiment of the present invention.

FIG. 3 is a circuit diagram showing the light source driving circuit 530 shown in FIG. 2, and FIG. 4 is a waveform diagram showing the analog voltage, a clamping voltage, and the current flowing through the first light emitting diode array LDA1.

Referring to FIG. 3, the light source driving circuit 530 includes a voltage range changing part (or voltage range changer) 600, a duty controller 605, a first control signal generating part (or first control signal generator) 660, and a second control signal generating part (or second control signal generator) 670.

The voltage range changing part 600 receives the analog voltage Vg and generates the clamping voltage Vd in response to the analog voltage Vg.

The analog voltage Vg has a first voltage range between a first lower limit and a first upper limit. In the present example embodiment, the first lower limit is about 0 volts and the first upper limit is about 3.3 volts. As shown in FIG. 4, the analog voltage Vg is linearly decreased from the first upper limit to the first lower limit.

The clamping voltage Vd has a second voltage range between a second lower limit and a second upper limit. The second lower limit is higher than the first lower limit and the second upper limit is lower than the first upper limit.

The clamping voltage Vd is generated by maintaining the voltage between the second upper limit and the first upper limit at the second upper limit in the analog voltage Vg and maintaining the voltage between the first lower limit and the second lower limit at the second lower limit in the analog voltage Vg. In the present example embodiment, the second lower limit is about 125 mV and the second upper limit is about 2.5 volts.

In the first mode, the voltage of the cathodes CA1 and CA2 of the first and second light emitting diode arrays LDA1 and LDA2 is determined by the clamping voltage Vd. Therefore, a waveform of a current Id flowing through the first and second light emitting diode arrays LDA1 and LDA2 follows a waveform of the clamping voltage Vd.

As shown in FIG. 4, an upper limit of the driving current Id flowing through the first and second light emitting diode arrays LDA1 and LDA2 in the first mode is about 100 mA, and a lower limit of the driving current Id flowing through the first and second light emitting diode arrays LDA1 and LDA2 in the first mode is about 5 mA. In the present example embodiment, the backlight unit 500 may be operated in the second mode to allow the driving current Id flowing through the first and second light emitting diode arrays LDA1 and LDA2 to be equal to or lower than about 5 mA. During the second mode, the voltage level of the driving voltage Vout is lower than that of the driving voltage Vout in the first mode. The voltage level of the driving voltage Vout is controlled by controlling the duty ratio of the main driving signal MDR applied to the control terminal of the main transistor MTF.

The duty controller 605 receives the main node voltage ISW, a light source resistor voltage ISEN, the clamping voltage Vd, and the analog voltage Vg. The light source resistor voltage ISEN may be either the first node voltage VR1 or the second node voltage VR2. For example, the light source resistor voltage ISEN corresponds to a relatively low voltage of the first and second node voltages VR1 and VR2. The duty controller 605 generates the main driving signal MDR, in which the duty ratio thereof is determined, on the basis of the main node voltage ISW, the light source resistor voltage ISEN, the clamping voltage Vd, the clock signal CLK, and the analog voltage Vg.

The duty controller 605 includes an amplifier 650, an offset compensator 610, an error amplifier 620, a main comparator 630, and a latch 640.

The amplifier 650 receives the main node voltage ISW and amplifies an amplitude of the main node voltage ISW to generate the amplified main node voltage ISW-A. The amplifier 650 applies the amplified main node voltage ISW-A to the offset compensator 610.

In the present example embodiment, the amplifier 650 may be omitted. In this case, the main node voltage ISW is applied to the offset compensator 610 without being amplified.

The offset compensator 610 is connected between a non-inverting input terminal of the main comparator 630 and the amplifier 650. The offset compensator 610 receives the amplified main node voltage ISW-A and the analog voltage Vg. During the second mode, the offset compensator 610 compensates for the level of the amplified main node voltage ISW-A to generate a main voltage signal ISW-1.

The clamping voltage Vd is applied to a non-inverting input terminal of the error amplifier 620, and the light source resistor voltage ISEN is applied to an inverting input terminal of the error amplifier 620. The error amplifier 620 outputs an amp output signal SST through an output terminal thereof to allow the clamping voltage Vd to be equal to the light source resistor voltage ISEN. The inverting input terminal and the non-inverting input terminal of the error amplifier 620 are changed with respect to one another.

The main voltage signal ISW-1 is applied to a non-inverting input terminal of the main comparator 630, and the amp output signal SST is applied to an inverting input terminal of the main comparator 630. An output signal RSS output from the main comparator 630 is a high signal when the level of the signal applied to the non-inverting input terminal is higher than the level of the signal applied to the inverting input terminal, and is a low signal when the level of the signal applied to the non-inverting input terminal is lower than the level of the signal applied to the inverting input terminal.

The latch 640 may be, but is not limited to, an S-R latch. The output signal RSS output from the main comparator 630 is applied to a reset terminal R of the latch 640 and the clock signal CLK is applied to a set terminal S of the latch 640. The latch 640 outputs the main driving signal MDR through an output terminal Q thereof.

The first control signal generating part (or first control signal generator) 660 may be, but is not limited to, a differential amplifier. The clamping voltage Vd is applied to a first input terminal of the first control signal generating part 660, and the first node voltage VR1 is applied to a second input terminal of the first control signal generating part 660. The first control signal controlling part 660 amplifies a difference between the clamping voltage Vd and the first node voltage VR1 to generate the first control signal CTL1.

The second control signal generating part (or second control signal generator) 670 may be, but is not limited to, a differential amplifier. The clamping voltage Vd is applied to a first input terminal of the second control signal generating part 670, and the second node voltage VR2 is applied to a second input terminal of the second control signal generating part 670. The second control signal controlling part 670 amplifies a difference between the clamping voltage Vd and the second node voltage VR2 to generate the second control signal CTL2.

Figure 5:
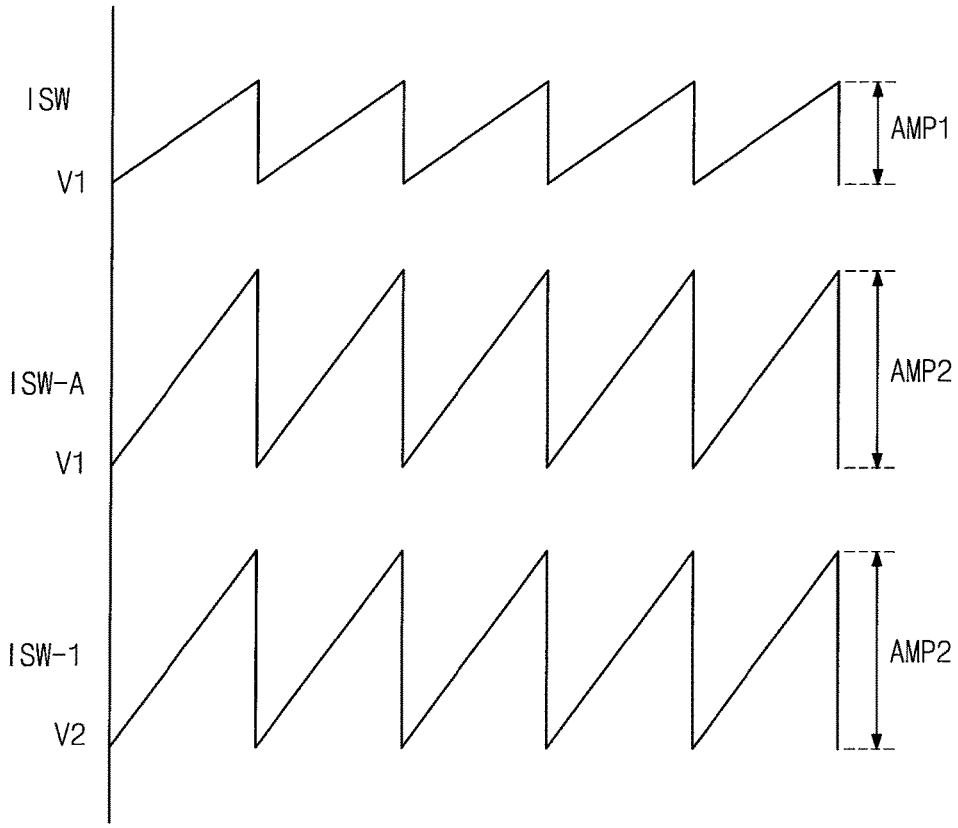
FIG. 5 is a view showing a main node voltage, an amplified main node voltage, and a main voltage signal, according to an example embodiment of the present invention.

FIG. 5 is a view showing the main node voltage ISW, the amplified main node voltage ISW-A, and the main voltage signal ISW-1.

Figure 6:
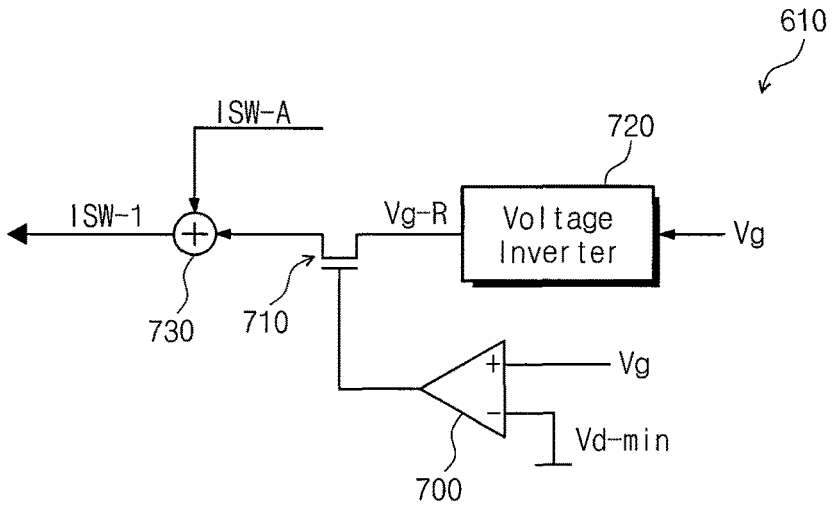
FIG. 6 is a circuit diagram showing further detail of an offset compensator shown in FIG. 3.

Referring to FIGS. 2, 3, and 5, the main node voltage ISW has a triangular pulse waveform due to the operation of the inductor L1 and the main transistor MTF. As shown in FIG. 6, the main node voltage ISW has a first amplitude AMP1 and the amplified main node voltage ISW-A has a second amplitude AMP2 greater than the first amplitude AMP1. The main node voltage ISW and the amplified main node voltage ISW-A may have the same frequency. In addition, the main node voltage ISW and the amplified main node voltage ISW-A may have the same minimum voltage level V1. The waveform of the main voltage signal ISW-1 will be described in more detail below.

FIG. 6 is a circuit diagram showing further detail of the offset compensator 610 shown in FIG. 3.

Referring to FIG. 6, the offset compensator 610 includes a comparator 700, an offset transistor 710, a voltage inverter 720, and an adder 730.

The analog voltage Vg is applied to a non-inverting input terminal of the comparator 700, and a voltage corresponding to the second lower limit Vd-min of the clamping voltage Vd is applied to an inverting input terminal of the comparator 700. The comparator 700 outputs a high signal when the level of the signal applied to the non-inverting input terminal of the comparator 700 is higher than the level of the signal applied to the inverting input terminal of the comparator 700, and outputs a low signal when the level of the signal applied to the non-inverting input terminal of the comparator 700 is higher than the level of the signal applied to the inverting input terminal of the comparator 700.

The offset transistor 710 is a three-terminal transistor including a first terminal, a second terminal, and a control terminal. The offset transistor 710 may be, but is not limited to, a field effect transistor (FET) or a bipolar junction transistor (BJT).

In the present example embodiment, the offset transistor 710 may be a field effect transistor with a p-channel. The output signal from the comparator 700 is applied to the control terminal of the offset transistor 710. The offset transistor 710 is turned on when the signal applied to the control terminal is a low signal, and is turned off when the signal applied to the control terminal is a high signal. The first terminal of the offset transistor 710 is connected to the voltage inverter 720, and the second terminal of the offset transistor 710 is connected to the adder 730.

The voltage inverter 720 receives the analog voltage Vg and inverts the analog voltage Vg to generate an inverted analog voltage Vg-R. The inverted analog voltage Vg-R may be obtained by subtracting the analog voltage Vg from the voltage corresponding to the second lower limit Vd-min of the clamping voltage Vd.

The adder 730 outputs a signal obtained by adding the amplified main node voltage ISW-A and the inverted analog voltage Vg-R as the main voltage signal ISW-1 when the offset transistor 710 is turned on. The adder 730 outputs the amplified main node voltage ISW-A as the main voltage signal ISW-1 when the offset transistor 710 is turned off.

Referring to FIGS. 5 and 6, a minimum voltage level V2 of the main voltage signal ISW-1 may be greater than the minimum voltage level V1 of the main node voltage ISW when the offset transistor 710 is turned on. The minimum voltage level V2 of the main voltage signal ISW-1 may be the same as the minimum voltage level V1 of the main node voltage ISW when the offset transistor 710 is turned off.

Hereinafter, an operation of the offset compensator 610 according to the level of the analog voltage Vg will be described in more detail with reference to FIG. 6.

When the analog voltage Vg is greater than the second lower limit Vd-min, for example, about 125 mV, of the clamping voltage Vd, the comparator 700 applies the high signal to the control terminal of the offset transistor 710 and the offset transistor 710 is turned off. The adder 730 outputs the amplified main node voltage ISW-A as the main voltage signal ISW-1.

When the analog voltage Vg is smaller than the second lower limit Vd-min, for example, about 125 mV, of the clamping voltage Vd, the comparator 700 applies the low signal to the control terminal of the offset transistor 710 and the offset transistor 710 is turned on. The adder 730 outputs the signal obtained by adding the amplified main node voltage ISW-A and the inverted analog voltage Vg-R as the main voltage signal ISW-1.

Figure 7:
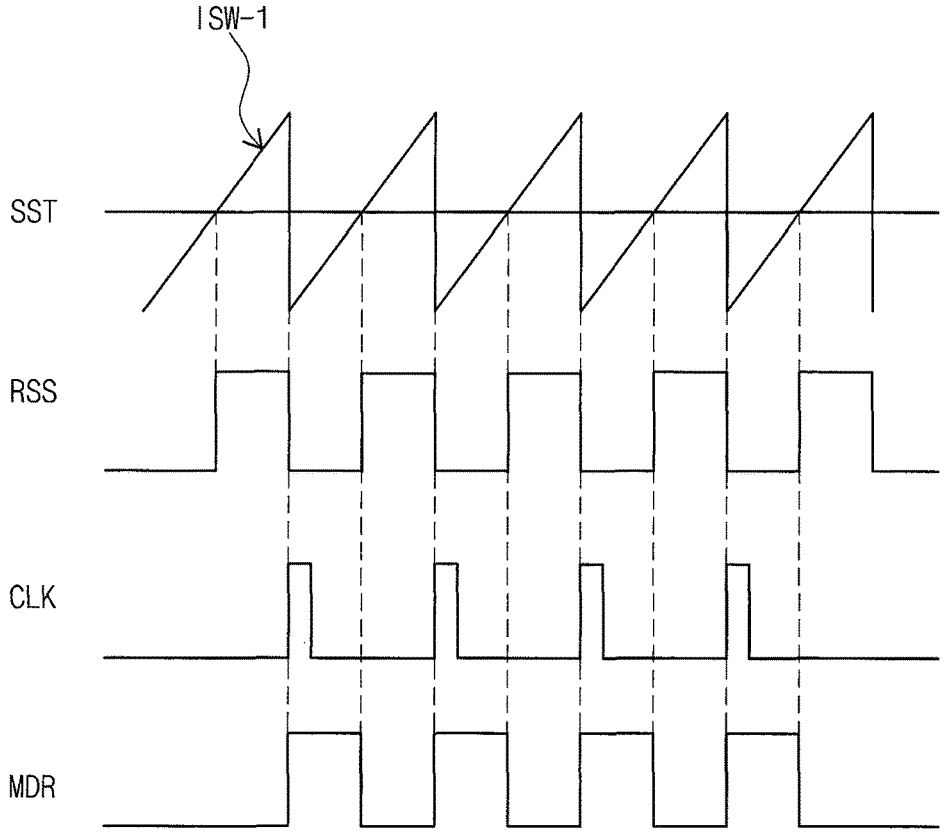
FIG. 7 is a view showing further detail of signals input to or output from the main comparator and a latch shown in FIG. 3.

FIG. 7 is a view showing signals input to or output from the main comparator 630 and the latch 640 shown in FIG. 3.

Hereinafter, an operation of the duty controller 605, which is to control the duty ratio of the main driving signal MDR, will be described in more detail with reference to FIGS. 2, 3, and 5 to 7.

The output signal RSS from the main comparator 630 is applied to the reset terminal R of the latch 640.

The main comparator 630 outputs the high signal during a period in which the level of the main voltage signal ISW-1 is greater than that of the amp output signal SST and outputs the low signal during a period in which the level of the main voltage signal ISW-1 is smaller than that of the amp output signal SST.

The clock signal CLK is applied to the set terminal S of the latch 640. The clock signal CLK has the same frequency as that of the main voltage signal ISW-1.

The main driving signal MDR has a pulse on period during a period from a rising edge of the clock signal CLK and a rising edge of the output signal RSS of the main comparator 630. The duty ratio of the main driving signal MDR is controlled depending on the rising edge of the output signal RSS of the main comparator 630.

When the analog voltage Vg is greater than the second lower limit Vd-min, for example, about 125 mV, of the clamping voltage Vd, the duty controller 605 is operated in the first mode. The waveform of the output signal RSS of the main comparator 630 is constant during the first mode.

When the analog voltage Vg is smaller than the second lower limit Vd-min, for example, about 125 mV, of the clamping voltage Vd, the duty controller 605 is operated in the second mode. The level of the main voltage signal ISW-1 in the second mode is higher than that of the main voltage signal ISW-1 in the first mode. In addition, the level of the amp output signal SST is constant during the first and second modes. Thus, the rising edge of the output signal RSS of the main comparator 630 moves forward in one period. During the second mode, the duty ratio of the main driving signal MDR is reduced compared to that of the first mode, and the driving voltage Vout in the second mode is reduced compared to that of the first mode. During the second mode, the level of the driving voltage Vout becomes lower as the level of the analog voltage Vg becomes lower.

Figure 8:
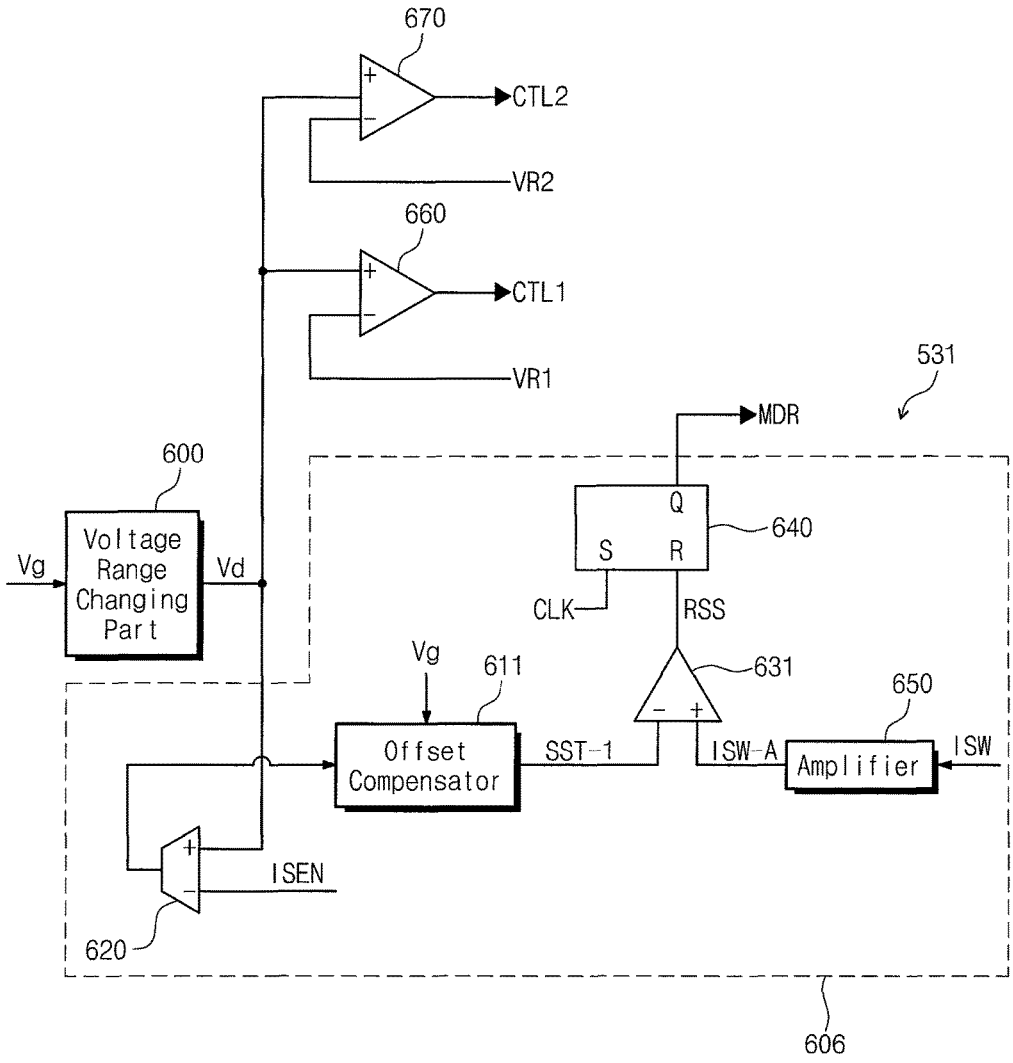
FIG. 8 is a circuit diagram showing a light source driving circuit, according to an example embodiment of the present invention.

FIG. 8 is a circuit diagram showing a light source driving circuit 531 according to another example embodiment of the present invention.

Referring to FIG. 8, the light source driving circuit 531 includes a voltage range changing part 600, a duty controller 606, a first control signal generating part 660, and a second control signal generating part 670. The duty controller 606 has the same or similar structure and function as those of the duty controller 605 shown in FIG. 3 except for an offset compensator 611 and a main comparator 631. Hereinafter, the offset compensator 611 and the main comparator 631 will be described in more detail, and some details of other similar components will be omitted.

The offset compensator 611 is connected to an inverting input terminal of the main comparator 630 and an output terminal of the error amplifier 620. The offset compensator 611 receives an amp output signal SST and an analog voltage Vg. During the second mode, the offset compensator 611 compensates for the level of the amp output signal SST to generate an amp compensation signal SST-1.

The amplified main node voltage ISW-A is applied to a non-inverting input terminal of the main comparator 631, and the amp compensation signal SST-1 is applied to the inverting input terminal.

Figure 9:
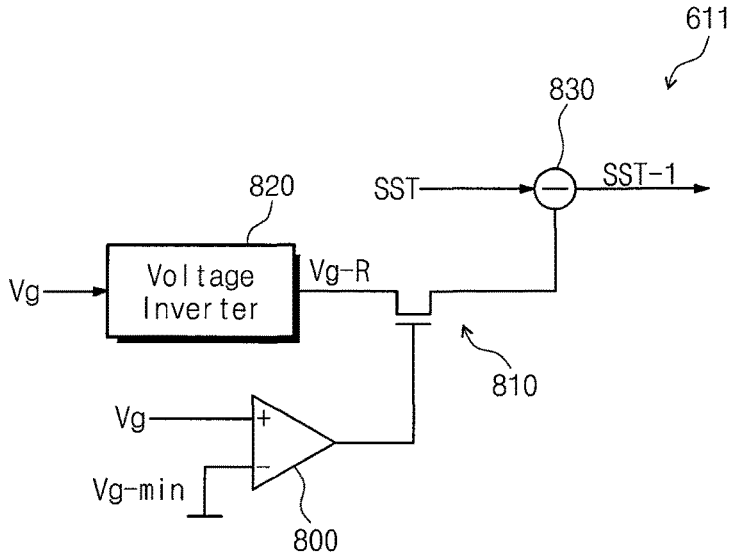
FIG. 9 is a circuit diagram showing further detail of an offset compensator shown in FIG. 8.

FIG. 9 is a circuit diagram showing further details of the offset compensator 611 shown in FIG. 8.

Referring to FIG. 9, the offset compensator 611 includes a comparator 800, an offset transistor 810, a voltage inverter 820, and a subtractor 830.

The analog voltage Vg is applied to a non-inverting input terminal of the comparator 800, and the voltage corresponding to the second lower limit Vd-min of the clamping voltage Vd is applied to an inverting input terminal of the comparator 800. The comparator 800 outputs a high signal when the level of the signal applied to the non-inverting input terminal of the comparator 800 is higher than the level of the signal applied to the inverting input terminal of the comparator 800, and outputs a low signal when the level of the signal applied to the non-inverting input terminal of the comparator 800 is lower than the level of the signal applied to the inverting input terminal of the comparator 800.

The offset transistor 810 is a three-terminal transistor including a first terminal, a second terminal, and a control terminal. The offset transistor 810 is a field effect transistor or a bipolar junction transistor.

In the present example embodiment, the offset transistor 810 may be a field effect transistor with a p-channel. The output signal from the comparator 800 is applied to the control terminal of the offset transistor 810. The offset transistor 810 is turned on when the signal applied to the control terminal is a low signal, and is turned off when the signal applied to the control terminal is a high signal.

The voltage inverter 720 receives the analog voltage Vg and inverts the analog voltage Vg to generate the inverted analog voltage Vg-R. The inverted analog voltage Vg-R may be obtained by subtracting the analog voltage Vg from the voltage corresponding to the second lower limit Vd-min of the clamping voltage Vd.

The subtractor 830 outputs a signal obtained by subtracting the inverted analog voltage Vg-R from the amp output signal SST as the amp compensation signal SSt-1 when the offset transistor 810 is turned on. When the offset transistor 810 is turned on, the level of the amp compensation signal SST-1 is lower than the level of the amp output signal SST.

The subtractor 830 outputs the amp output signal SST as the amp compensation signal SST-1 when the offset transistor 810 is turned off.

Hereinafter, an operation of the offset compensator 611 according to the level of the analog voltage Vg will be described in more detail with reference to FIG. 9.

When the analog voltage Vg is greater than the second lower limit Vd-min, for example, about 125 mV, of the clamping voltage Vd, the comparator 800 applies the high signal to the control terminal of the offset transistor 810 and the offset transistor 710 is turned off. The subtractor 830 outputs the amp output signal SST as the amp compensation signal SST-1.

When the analog voltage Vg is smaller than the second lower limit Vd-min, for example, about 125 mV, of the clamping voltage Vd, the comparator 800 applies the low signal to the control terminal of the offset transistor 810 and the offset transistor 710 is turned on. The subtractor 830 outputs the signal obtained by subtracting the inverted analog voltage Vg-R from the amp output signal SST as the amp compensation signal SST-1.

Figure 10:
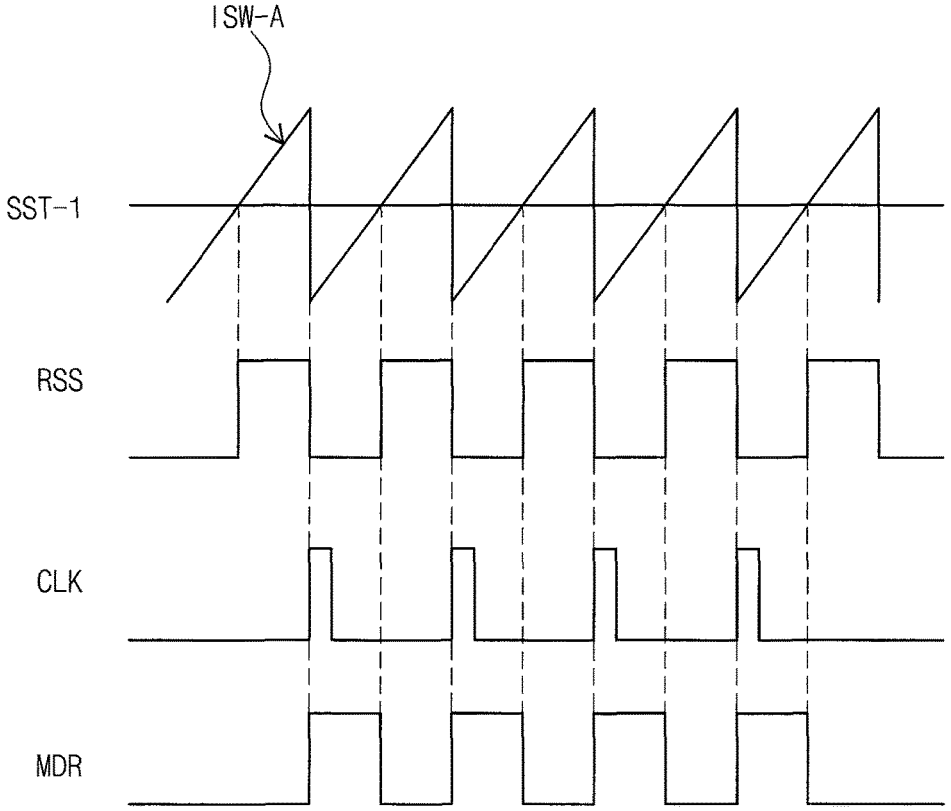
FIG. 10 is a view showing further detail of signals input to or output from the main comparator and the latch shown in FIG. 8.

FIG. 10 is a view showing signals input to or output from the main comparator 631 and the latch 640 shown in FIG. 8.

Hereinafter, the operation of the duty controller 606, which is to control the duty ratio of the main driving signal MDR, will be described more in detail with reference to FIGS. 2 and 8 to 10.

The output signal RSS of the main comparator 631 is applied to the reset terminal R of the latch 640.

The main comparator 631 outputs the high signal during a period in which the level of the amplified main node voltage ISW-A is greater than that of the amp compensation signal SST-1 and outputs the low signal during a period in which the level of the amplified main node voltage ISW-A is smaller than that of the amp compensation signal SST-1.

The clock signal CLK is applied to the set terminal S of the latch 640. The clock CLK has the same frequency as the amplified main node voltage ISW-A.

The main driving signal MDR has a pulse on period during a period from a rising edge of the clock signal CLK and a rising edge of the output signal RSS of the main comparator 631. The duty ratio of the main driving signal MDR is controlled depending on the rising edge of the output signal RSS of the main comparator 631.

When the analog voltage Vg is greater than the second lower limit Vd-min, for example, about 125 mV, of the clamping voltage Vd, the duty controller 606 is operated in the first mode. The waveform of the output signal RSS of the main comparator 631 is constant during the first mode.

When the analog voltage Vg is smaller than the second lower limit Vd-min, for example, about 125 mV, of the clamping voltage Vd, the duty controller 605 is operated in the second mode. The level of the amp compensation signal SST-1 in the second mode is lower than that of the amp compensation signal SST-1 in the first mode. In addition, the waveform of the amplified main node voltage ISW-A is constant during the first and second modes. Accordingly, the rising edge of the output signal RSS of the main comparator 630 moves forward in one period. During the second mode, the duty ratio of the main driving signal MDR is reduced compared to that of the first mode, and the driving voltage Vout in the second mode is reduced compared to that of the first mode.

Figure 11:
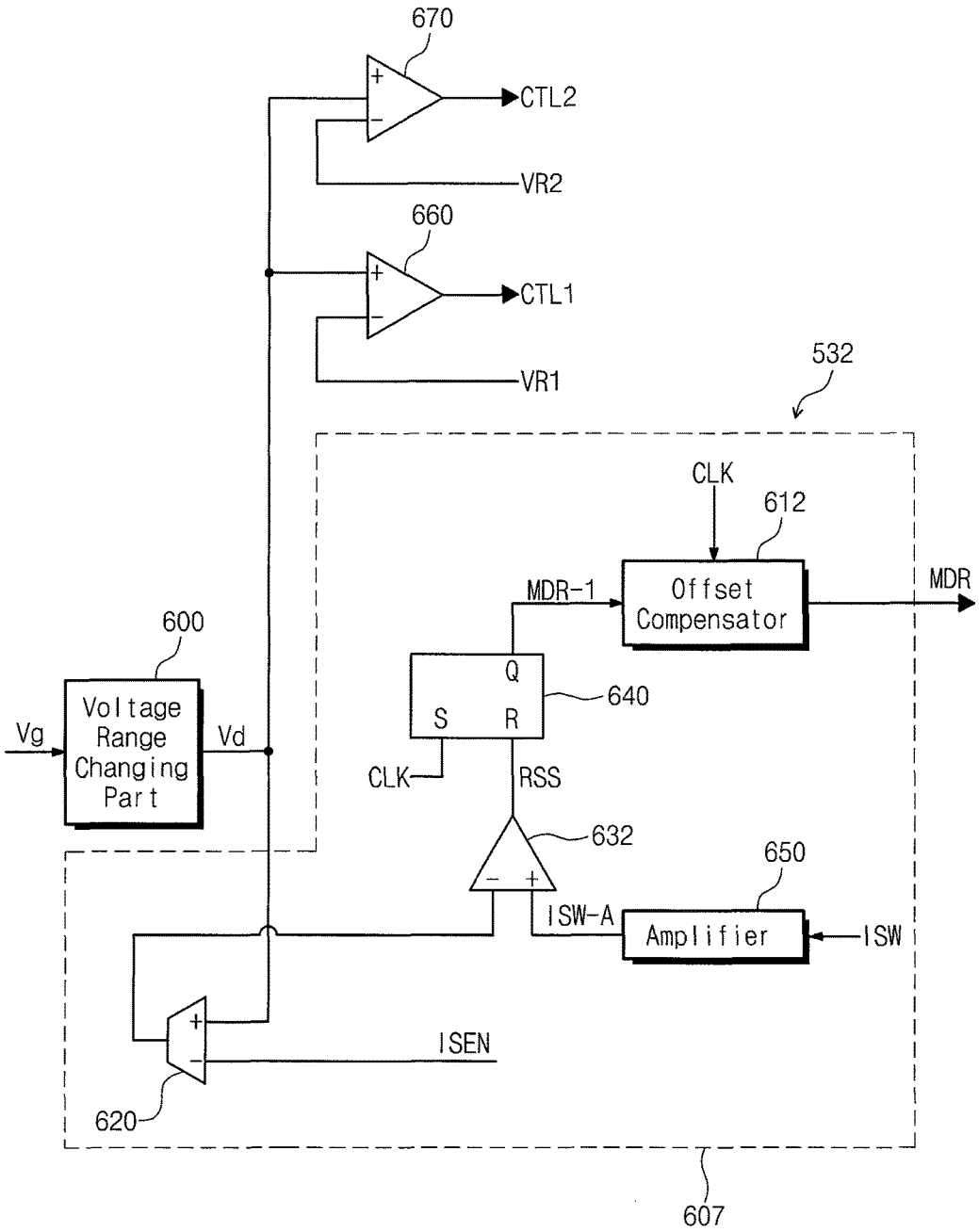
FIG. 11 is a circuit diagram showing a light source driving circuit, according to an example embodiment of the present invention.

FIG. 11 is a circuit diagram showing a light source driving circuit 532 according to another example embodiment of the present invention.

Referring to FIG. 11, the light source driving circuit 532 includes a voltage range changing part 600, a duty controller 607, a first control signal generating part 660, and a second control signal generating part 670. The duty controller 607 has the same or similar structure and function as those of the duty controller 605 shown in FIG. 3 except for an offset compensator 612 and a main comparator 632. Hereinafter, the offset compensator 612 and the main comparator 632 will be described in more detail, and some details of other components may be omitted.

The offset compensator 612 is connected to an output terminal Q of the latch. The offset compensator 612 receives an initial main driving signal MDR-1 from the output terminal Q of the latch 640 and controls a duty ratio of the initial main driving signal MDR-1 to generate the main driving signal MDR.

The amplified main node voltage ISW-A is applied to a non-inverting input terminal of the main comparator 632, and the amp output signal SST is applied to an inverting input terminal of the main comparator 632.

Figure 12:
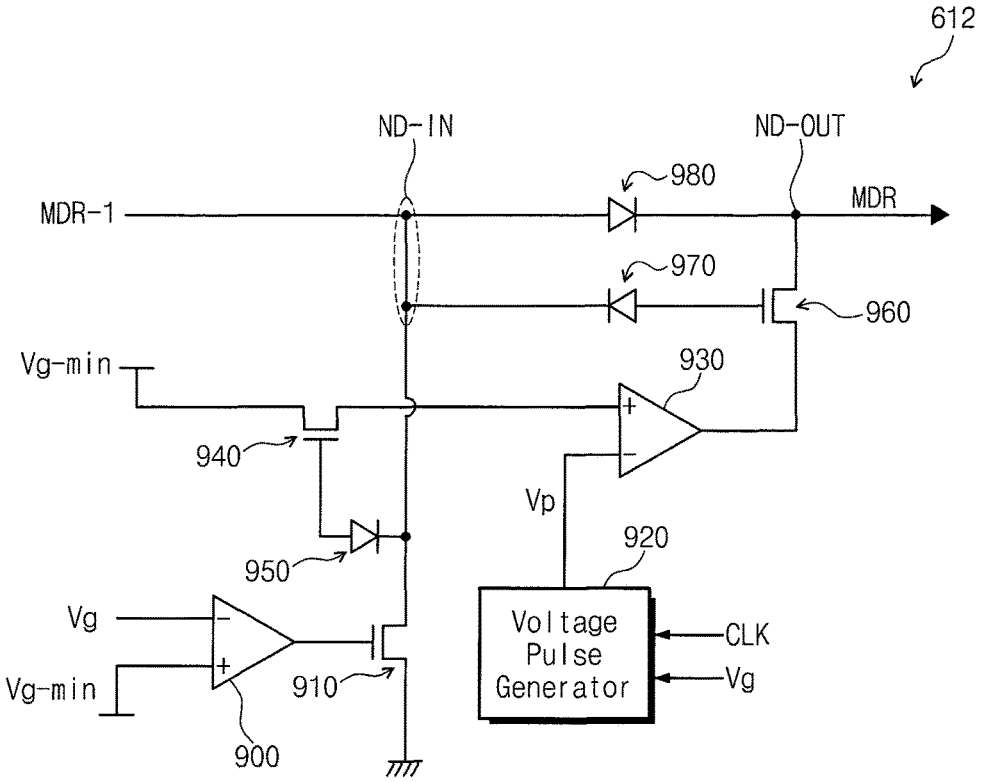
FIG. 12 is a circuit diagram showing further detail of the offset compensator shown in FIG. 11.

FIG. 12 is a circuit diagram showing the offset compensator 612 shown in FIG. 11.

Referring to FIG. 12, the offset compensator 612 includes a first comparator 900, a first offset transistor 910, a voltage pulse generator 920, a second comparator 930, a second offset transistor 940, a first diode 950, a third offset transistor 960, a second diode 970, and a third diode 980.

The analog voltage Vg is applied to an inverting input terminal of the first comparator 900, and the voltage corresponding to the second lower limit Vd-min of the clamping voltage Vd is applied to a non-inverting input terminal of the first comparator 900. The first comparator 900 outputs a high signal when the level of the signal applied to the non-inverting input terminal of the first comparator 900 is higher than the level of the signal applied to the inverting input terminal of the first comparator 900, and outputs a low signal when the level of the signal applied to the non-inverting input terminal of the first comparator 900 is lower than the level of the signal applied to the inverting input terminal of the first comparator 900.

The first offset transistor 910 is a three-terminal transistor including a first terminal, a second terminal, and a control terminal. The output signal from the first comparator 900 is applied to the control terminal of the first offset transistor 910. The first terminal of the first offset transistor 910 receives the initial main driving signal MDR-1, and the second terminal of the first offset transistor 910 is grounded.

In the present example embodiment, the first offset transistor 910 may be, but is not limited to, a field effect transistor with an n-channel. The first offset transistor 910 is turned on when the output signal from the first comparator 900 is the high signal and turned off when the output signal from the first comparator 900 is the low signal.

The voltage pulse generator 920 receives the clock signal CLK and the analog voltage Vg. The voltage pulse generator 920 generates a voltage pulse signal Vp on the basis of the clock signal CLK and the analog voltage Vg.

A non-inverting input terminal of the second comparator 930 is connected to the second terminal of the second offset transistor 940, and an inverting input terminal of the second comparator 930 receives the voltage pulse signal Vp. The voltage corresponding to the second lower limit Vd-min of the clamping voltage Vd is applied to the non-inverting input terminal of the second comparator 930 when the second offset transistor 940 is turned on. The second comparator 930 outputs a high signal when the level of the signal applied to the non-inverting input terminal of the second comparator 930 is higher than the level of the signal applied to the inverting input terminal of the second comparator 930, and outputs a low signal when the level of the signal applied to the non-inverting input terminal of the second comparator 930 is lower than the level of the signal applied to the inverting input terminal of the second comparator 930.

The second offset transistor 940 is a three-terminal transistor including a first terminal, a second terminal, and a control terminal. The control terminal of the second offset transistor 940 is connected to the first diode 950. The control terminal of the second offset transistor 940 is grounded when the first offset transistor 910 is turned on. The first terminal of the second offset transistor 940 receives the second lower limit Vd-min of the clamping voltage Vd, and the second terminal of the second offset transistor 940 is connected to the non-inverting input terminal of the second comparator 930.

In the present example embodiment, the second offset transistor 940 may be, but is not limited to, a field effect transistor with a p-channel. The second offset transistor 940 is turned on when the signal applied to the control terminal of the second offset transistor 940 is the low signal, and turned off when the signal applied to the control terminal of the second offset transistor 940 is the high signal.

The first diode 950 is connected between the control terminal of the second offset transistor 940 and the first terminal of the first offset transistor 910. The first diode 950 transmits a current flowing from the control terminal of the second offset transistor 940 to the first terminal of the first offset transistor 910 and blocks a current from the first terminal of the first offset transistor 910 to the control terminal of the second offset transistor 940.

The third offset transistor 960 is a three-terminal transistor including a first terminal, a second terminal, and a control terminal. The control terminal of the third offset transistor 960 is connected to the second diode 970. The control terminal of the third offset transistor 960 is grounded when the first offset transistor 910 is turned on. The first terminal of the third offset transistor 960 receives the output signal from the second comparator 930, and the second terminal of the third offset transistor 960 is connected to an output node ND-OUT. The main driving signal MDR is output through the output node ND-OUT.

In the present example embodiment, the third offset transistor 960 may be, but is not limited to, a field effect transistor with a p-channel. The third offset transistor 960 is turned on when the signal applied to the control terminal of the third offset transistor 960 is the low signal, and turned off when the signal applied to the control terminal of the third offset transistor 960 is the high signal.

The second diode 970 is connected between the control terminal of the third offset transistor 960 and an input node ND-IN connected to the first terminal of the first offset transistor 910. The second diode 970 transmits a current flowing from the control terminal of the third offset transistor 960 to the input node ND-IN and blocks a current flowing from the input node ND-IN to the control terminal of the third offset transistor 960.

The third diode 980 is connected between the output node ND-OUT and the input node ND-IN. The third diode 980 transmits a current flowing from the input node ND-IN to the output node ND-OUT and blocks a current flowing from the output ND-OUT to the input node ND-IN.

Figure 13:
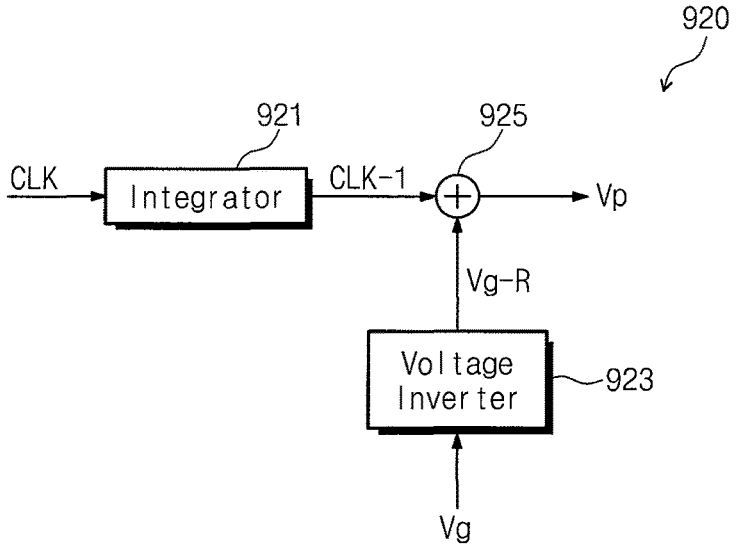
FIG. 13 is a view showing further detail of the voltage pulse generator shown in FIG. 12.

FIG. 13 is a view showing further details of the voltage pulse generator 920 shown in FIG. 12.

Referring to FIG. 13, the voltage pulse generator 920 includes an integrator 921, a voltage inverter 923, and an adder 925.

The integrator 921 receives the clock signal CLK and generates a triangular pulse signal CLK-1 having the same frequency as that of the clock signal CLK. The triangular pulse signal CLK-1 is a signal obtained by integrating the clock signal CLK in the unit of one period. A quadrangular area determined by the high period and the high level of the clock signal CLK in the one period may be substantially the same as a triangular area determined by the one period and a maximum level of the triangular pulse signal CLK-1.

The voltage inverter 923 receives the analog voltage Vg and inverts the analog voltage Vg to generate the inverted analog voltage Vg-R. The inverter analog voltage Vg-R is obtained by subtracting the analog voltage Vg from the voltage corresponding to the second lower limit Vd-min of the clamping voltage Vd.

The adder 935 outputs a signal obtained by adding the triangular pulse signal CLK-1 and the inverted analog voltage Vg-R as the voltage pulse signal Vp.

Figure 14:
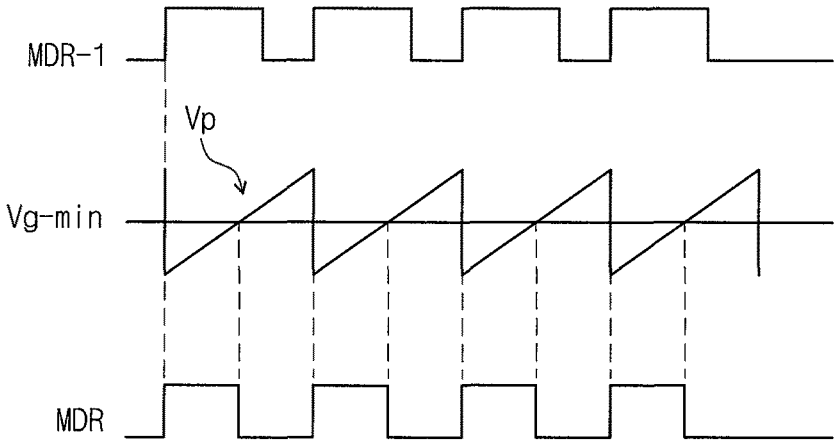
FIG. 14 is a view showing further detail of signals input to or output from a second comparator during a second mode, according to an example embodiment of the present invention.

FIG. 14 is a view showing signals input to or output from the second comparator 930 during the second mode.

Hereinafter, the operation of the offset compensator 612 in accordance with the level of the analog voltage Vg will be described in more detail with reference to FIGS. 12 to 14.

When the analog voltage Vg is greater than the second lower limit Vd-min (for example, about 125 mV), of the clamping voltage Vd, the first comparator 900 outputs the low signal and the first offset transistor 910 is turned off. The offset compensator 612 is operated in the first mode. The initial main driving signal MDR-1 applied to the input node ND-IN is output as the main driving signal MDR after passing through the third diode 980 and the output node ND-OUT.

When the analog voltage Vg is smaller than the second lower limit Vd-min (for example, about 125 mV), of the clamping voltage Vd, the first comparator 900 outputs the high signal and the first offset transistor 910 is turned on. The offset compensator 612 is operated in the second mode.

When the offset compensator 612 is operated in the second mode, the initial main driving signal MDR-1 is applied to the ground through the first offset transistor 910. In addition, because the control terminal of the second offset transistor 940 is grounded, the second offset transistor 940 is turned on. The voltage corresponding to the second lower limit Vd-min of the clamping voltage Vd is applied to the non-inverting input terminal of the second comparator 930.

Because the inverted analog voltage Vg-R increases as the analog voltage Vg decreases, the level of the voltage pulse signal Vp increases. When the level of the voltage pulse signal Vp increases, a period in which the second lower limit Vd-min of the clamping voltage Vd is higher than the level of the voltage pulse signal Vp is reduced. Therefore, the duty ratio of the output signal of the second comparator 930 is reduced.

The control terminal of the third offset transistor 960 is grounded, and thus the third offset transistor 960 is turned on. The output signal of the second comparator 930 is output as the main driving signal MDR through the output node ND-OUT.

Figure 15:
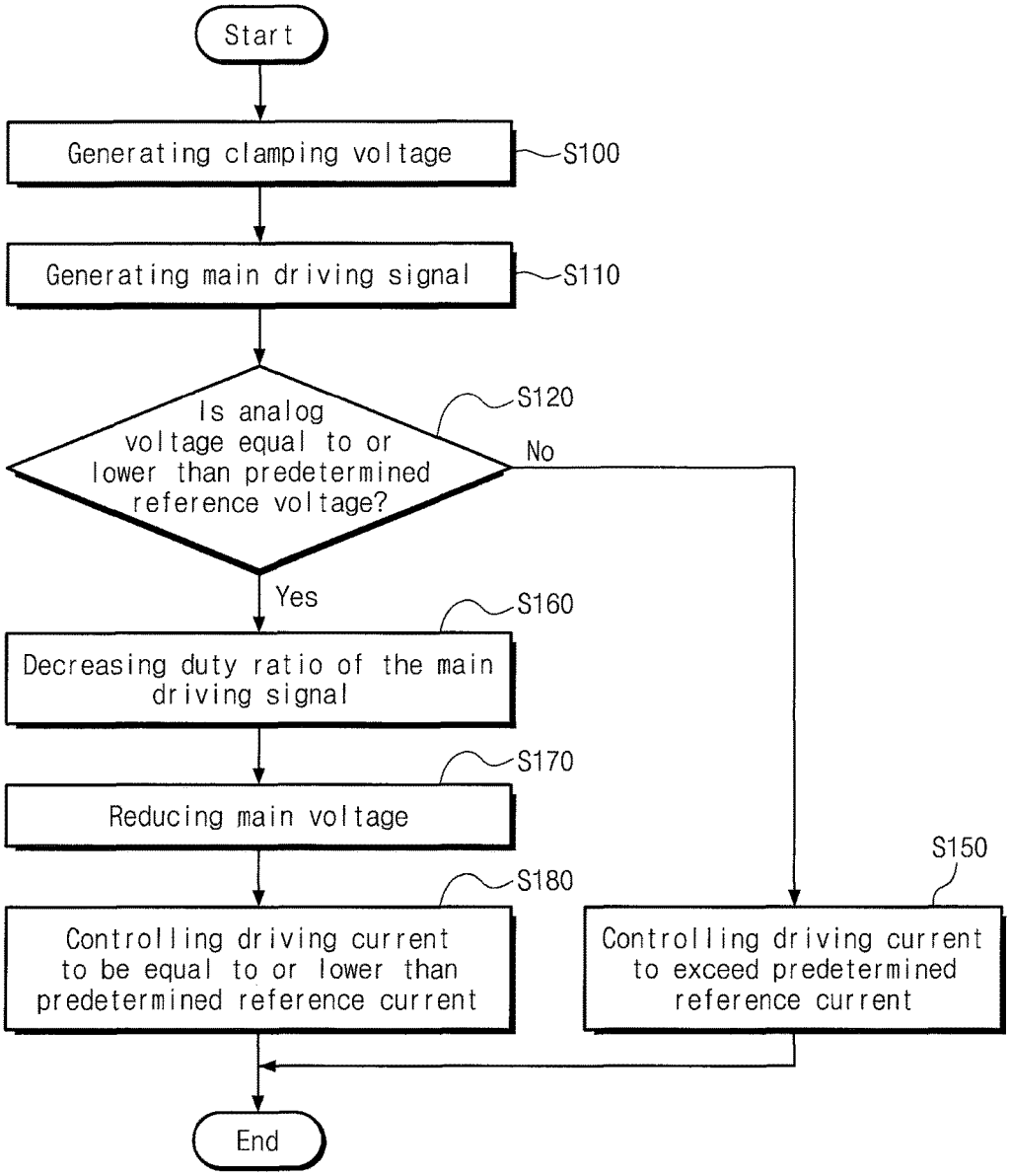
FIG. 15 is a flowchart showing a method of driving a backlight unit, according to an example embodiment of the present invention.

FIG. 15 is a flowchart showing a method of driving a backlight unit according to an example embodiment of the present invention.

Referring to FIGS. 1 to 15, the clamping voltage Vd is generated on the basis of the analog voltage Vg (S100). The analog voltage Vg has the voltage range between the first lower limit and the first upper limit. The clamping voltage Vd has the voltage range between the second lower limit higher than the first lower limit and the second upper limit lower than the first upper limit.

Then, the main driving signal MDR is generated on the basis of the analog voltage VG and the clamping voltage Vd (S110). The main driving signal MDR may be the signal applied to the control terminal of the main transistor MTF of the DC/DC converter 520. The driving voltage Vout output from the DC/DC converter 520 may be controlled by the duty ratio of the main driving signal MDR.

After that, it is determined whether or not the analog voltage Vg is equal to or lower than the reference voltage (e.g., the predetermined reference voltage) (S120). The reference voltage (e.g., the predetermined reference voltage) is the second lower limit. In the present example embodiment, the second lower limit is about 125 mV.

When the analog voltage exceeds the reference voltage (e.g., the predetermined reference voltage), the driving current flowing through the light emitting diode array is controlled to exceed the reference current (e.g., the predetermined reference current) (S150). In the present example embodiment, the reference current (e.g., the predetermined reference current) is about 5 mA (refer to FIG. 4).

When the analog voltage is equal to or lower than the reference voltage (e.g., the predetermined reference voltage), the duty ratio of the main driving signal MDR becomes smaller (S160). When the duty ratio of the main driving signal MDR becomes smaller, the driving voltage Vout is reduced (S170). When the driving voltage Vout is reduced, the driving current flowing through the light emitting diode array is controlled to be equal to or lower than the reference current (e.g., the predetermined reference current) (S180).

Thus, when the level of the analog voltage Vg is equal to or lower than the reference voltage (e.g., the predetermined reference voltage), the duty ratio of the main driving signal MDR and the driving voltage Vout are controlled to be lowered. As a result, the driving current flowing to the first and second light emitting diode arrays LDA1 and LDA2 may be controlled to be more reduced.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Although the example embodiments of the present invention have been described, it is understood that the present invention should not be limited to these example embodiments but various changes and modifications can be made by one ordinary skilled in the art within the spirit and scope of the present invention as defined in the following claims, and their equivalents.

What is claimed is:

1. A backlight unit comprising:

a light source comprising a light emitting diode array;

a DC/DC converter configured to receive an input voltage and to apply a driving voltage to the light emitting diode array; and a light source driving circuit configured to:

receive an analog voltage;

generate a clamping voltage according to the analog voltage; and generate a main driving signal to be applied to the DC/DC converter according to the analog voltage and the clamping voltage, wherein the analog voltage has a voltage range between a first lower limit and a first upper limit, the clamping voltage has a voltage range between a second lower limit higher than the first lower limit and a second upper limit lower than the first upper limit, the backlight unit is configured to operate in a first mode when the analog voltage has a first level between the second lower limit and the first upper limit, the backlight unit is configured to operate in a second mode when the analog voltage has a second level between the first lower limit and the second lower limit, and the driving voltage during the first mode is different from the driving voltage during the second mode; and the light source driving circuit comprises a duty controller including:

an error amplifier comprising a first terminal configured to receive the clamping voltage, a second terminal configured to receive a light source resistor voltage, and an output terminal configured to output an amp output signal;

an offset compensator configured to receive an amplified main node voltage by amplifying a main node voltage and the analog voltage and compensating for a level of the amplified main node voltage during the second mode to generate a main voltage signal;

a main comparator comprising a non-inverting input terminal configured to receive the main voltage signal and an inverting input terminal configured to receive the amp output signal and to compare the main voltage signal and the amp output signal to output a high signal or a low signal; and a latch comprising a set terminal configured to receive a clock signal, a rest terminal configured to receive an output signal from the main comparator, and an output terminal configured to output the main driving signal having a pulse-on period during a period from a rising edge of the clock signal to a rising edge of the output signal of the main comparator.

2. The backlight unit of claim 1, wherein the light source driving circuit is configured to control the main driving signal to allow the main driving signal in the second mode to have a duty ratio smaller than a duty ratio of the main driving signal in the first mode.

3. The backlight unit of claim 1, wherein the driving voltage decreases as a level of the analog voltage decreases during the second mode.

4. The backlight unit of claim 1, wherein the DC/DC converter comprises:

an inductor configured to receive the input voltage at a first terminal;

a main diode between a second terminal of the inductor and a first end of the light emitting diode array to apply the driving voltage to the first end of the light emitting diode array;

a main transistor comprising a first terminal connected to a node between the inductor and the main diode and a control terminal configured to receive the main driving signal; and a main resistor between a second terminal of the main transistor and a ground.

5. The backlight unit of claim 4, wherein the light source further comprises:

a current control transistor comprising a first terminal connected to a second end of the light emitting diode array and a control terminal configured to receive a control signal from the light source driving circuit; and a main resistor connected to a second terminal of the current control transistor and the ground.

6. The backlight unit of claim 5, wherein the light source driving circuit comprises:

a voltage range changer configured to generate the clamping voltage;

duty controller configured to generate the main driving signal according to the main node voltage from the second terminal of the main transistor, the light source resistor voltage from the second terminal of the current control transistor, the clamping voltage, the clock signal, and the analog voltage; and a control signal generator configured to generate the control signal according to the clamping voltage and the light source resistor voltage.

7. The backlight unit of claim 6, wherein the offset compensator comprises:

a comparator comprising a non-inverting input terminal configured to receive the analog voltage and an inverting input terminal configured to receive the second lower limit of the clamping voltage, the comparator being configured to compare the analog voltage and the second lower limit of the clamping voltage to output a high signal or a low signal;

a voltage inverter configured to generate an inverted analog voltage by subtracting the analog voltage from the second lower limit of the clamping voltage;

an offset transistor comprising a first terminal configured to receive the inverted analog voltage and a control terminal configured to receive an output signal from the comparator; and an adder configured to output a signal obtained by adding the amplified main node voltage and the inverted analog voltage as the main voltage signal when the offset transistor is turned on and to output the amplified main node voltage as the main voltage signal when the offset transistor is turned off.

8. The backlight unit of claim 7, wherein the offset transistor is a field effect transistor with a p-channel.

9. A backlight unit comprising:

a light source comprising a light emitting diode array;

a DC/DC converter configured to receive an input voltage and to apply a driving voltage to the light emitting diode array; and a light source driving circuit configured to:

receive an analog voltage;

generate a clamping voltage according to the analog voltage; and generate a main driving signal to be applied to the DC/DC converter according to the analog voltage and the clamping voltage, wherein the analog voltage has a voltage range between a first lower limit and a first upper limit, the clamping voltage has a voltage range between a second lower limit higher than the first lower limit and a second upper limit lower than the first upper limit, the backlight unit is configured to operate in a first mode when the analog voltage has a first level between the second lower limit and the first upper limit, the backlight unit is configured to operate in a second mode when the analog voltage has a second level between the first lower limit and the second lower limit, and the driving voltage during the first mode is different from the driving voltage during the second mode; and the light source driving circuit comprises a duty controller including:

an error amplifier comprising a first terminal configured to receive the clamping voltage, a second terminal configured to receive a light source resistor voltage, and an output terminal configured to output an amp output signal;

an offset compensator configured to receive the amp output signal and the analog voltage and to compensate for a level of the amp output signal during the second mode to generate an amp compensation signal;

a main comparator comprising a non-inverting input terminal configured to receive an amplified main node voltage obtained by amplifying a main node voltage, the main comparator further comprising an inverting input terminal configured to receive the amp compensation signal, the main comparator being configured to compare the amplified main node voltage and the amp compensation signal to output a high signal or a low signal; and a latch comprising a set terminal configured to receive a clock signal, a rest terminal configured to receive an output signal from the main comparator, and an output terminal configured to output the main driving signal having a pulse-on period during a period from a rising edge of the clock signal to a rising edge of the output signal of the main comparator.

10. The backlight unit of claim 9, wherein the offset compensator comprises:

a comparator comprising a non-inverting input terminal configured to receive the analog voltage and an inverting input terminal configured to receive the second lower limit of the clamping voltage, the comparator being configured to compare the analog voltage and the second lower limit of the clamping voltage to output a high signal or a low signal;

a voltage inverter configured to generate an inverted analog voltage by subtracting the analog voltage from the second lower limit of the clamping voltage;

an offset transistor comprising a first terminal configured to receive the inverted analog voltage and a control terminal configured to receive an output signal from the comparator; and an adder configured to output a signal obtained by adding the amplified main node voltage and the inverted analog voltage as a main voltage signal when the offset transistor is turned on and to output the amplified main node voltage as the main voltage signal when the offset transistor is turned off.

11. The backlight unit of claim 10, wherein the offset transistor is a field effect transistor with a p-channel.

12. A backlight unit comprising:

a light source comprising a light emitting diode array;

a DC/DC converter configured to receive an input voltage and to apply a driving voltage to the light emitting diode array; and a light source driving circuit configured to:

receive an analog voltage;

generate a clamping voltage according to the analog voltage; and generate a main driving signal to be applied to the DC/DC converter according to the analog voltage and the clamping voltage, wherein the analog voltage has a voltage range between a first lower limit and a first upper limit, the clamping voltage has a voltage range between a second lower limit higher than the first lower limit and a second upper limit lower than the first upper limit, the backlight unit is configured to operate in a first mode when the analog voltage has a first level between the second lower limit and the first upper limit, the backlight unit is configured to operate in a second mode when the analog voltage has a second level between the first lower limit and the second lower limit, and the driving voltage during the first mode is different from the driving voltage during the second mode; and the light source driving circuit comprises a duty controller including:

an error amplifier comprising a first terminal configured to receive the clamping voltage, a second terminal configured to receive a light source resistor voltage, and an output terminal configured to output an amp output signal;

a main comparator comprising a non-inverting input terminal configured to receive an amplified main node voltage by amplifying a main node voltage and an inverting input terminal configured to receive the amp output signal, the main comparator being configured to compare the amplified main node voltage and the amp output signal to output a high signal or a low signal;

a latch comprising a set terminal configured to receive a clock signal, a rest terminal configured to receive an output signal output from the main comparator, and an output terminal configured to output an initial main driving signal having a pulse-on period during a period from a rising edge of the clock signal to a rising edge of the output signal of the main comparator; and an offset compensator configured to control a duty ratio of the initial main driving signal during the second mode to generate the main driving signal.

13. The backlight unit of claim 12, wherein the offset compensator comprises:

a first comparator comprising a non-inverting input terminal configured to receive the analog voltage and an inverting input terminal configured to receive the second lower limit of the clamping voltage, the first comparator being configured to compare the analog voltage and the second lower limit of the clamping voltage to output a high signal or a low signal;

a first offset transistor comprising a first terminal configured to receive the initial main driving signal, a second terminal configured to receive a ground voltage, and a control terminal configured to receive an output signal from the first comparator;

a voltage pulse generator configured to receive the analog voltage and the clock signal to generate a voltage pulse signal;

a second offset transistor comprising a first terminal configured to receive the second lower limit of the clamping voltage and a control terminal configured to receive the ground voltage when the first offset transistor is turned on;

a second comparator comprising a non-inverting input terminal configured to receive the second lower limit of the clamping voltage through a second terminal of the second offset transistor when the second offset transistor is turned on and an inverting input terminal configured to receive the voltage pulse signal and to compare the second lower limit of the clamping voltage and the voltage pulse signal when the second offset transistor is turned on to output a high signal or a low signal; and a third offset transistor comprising a first terminal configured to receive an output signal from the second comparator, a second terminal configured to output the main driving signal, and a control terminal configured to receive the ground voltage when the first offset transistor is turned on.

14. The backlight unit of claim 13, wherein the first offset transistor is a field effect transistor having an n-channel and each of the second and third offset transistors is a field effect transistor having a p-channel.

15. The backlight unit of claim 13, wherein the voltage pulse generator comprises:

an integrator configured to receive the clock signal and to integrate the clock signal in a unit of one period to generate a triangular pulse signal;

a voltage inverter configured to generate an inverted analog voltage by subtracting the analog voltage from the second lower limit of the clamping voltage; and an adder configured to add the triangular pulse signal and the inverted analog voltage to generate the voltage pulse signal.

* * * * *